US006594861B2

(12) United States Patent
Dimig et al.

(10) Patent No.: US 6,594,861 B2
(45) Date of Patent: Jul. 22, 2003

(54) MOTOR VEHICLE DOOR HANDLE APPARATUS AND METHOD OF INSTALLATION

(75) Inventors: Steven J. Dimig, Plymouth, WI (US); John K. Feuerstein, Racine, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 09/910,459

(22) Filed: Jul. 20, 2001

(65) Prior Publication Data

US 2003/0014835 A1 Jan. 23, 2003

(51) Int. Cl.[7] ..... E05B 1/00
(52) U.S. Cl. ..... 16/412; 292/347; 292/336.3
(58) Field of Search ..... 16/412, 436, 438, 16/413, 414, 110.1, DIG. 24; 292/336.3, 348, 353, 352, DIG. 30, DIG. 31, DIG. 53, DIG. 69, 347

(56) References Cited

U.S. PATENT DOCUMENTS

| | | | | |
|---|---|---|---|---|
| 4,038,718 A | | 8/1977 | Reilhac et al. | |
| 4,492,396 A | | 1/1985 | Luke et al. | |
| 4,898,415 A | | 2/1990 | Satoh | |
| 5,011,202 A | | 4/1991 | Kato et al. | |
| 5,183,302 A | | 2/1993 | Pelachyk et al. | |
| 5,238,276 A | | 8/1993 | Burns | |
| 5,248,175 A | | 9/1993 | Burns | |
| 5,263,750 A | | 11/1993 | Smith et al. | |
| 5,282,657 A | | 2/1994 | Clinch et al. | |
| 5,284,373 A | * | 2/1994 | Watson | 292/347 |
| 5,340,174 A | | 8/1994 | Bender et al. | |
| 5,651,163 A | | 7/1997 | Tamaki | |
| 5,706,554 A | | 1/1998 | Rückert et al. | |
| 6,059,329 A | * | 5/2000 | Spitzley | 16/412 |

* cited by examiner

*Primary Examiner*—Robert E. Pezzuto
(74) *Attorney, Agent, or Firm*—Michael Best & Friedrich LLP

(57) ABSTRACT

In some preferred embodiments of the present invention, a fastener on a door handle assembly having a door handle is moved by actuation of the door handle into a position in which the fastener connects the door handle assembly to the door. The door handle is preferably capable of transmitting door handle actuation force to the fastener to move the fastener. In one preferred embodiment, this force is transmitted by camming action against a sliding member to which the fastener is connected. In another embodiment, this force is transmitted by pulling a sliding member with links connected to the handle. The movable fastener can connect with a second fastener connected to the door handle assembly or to the door. Therefore, when the movable fastener is moved by actuation of the handle, the movable fastener can connect with the second fastener to secure the door handle assembly to the door.

78 Claims, 22 Drawing Sheets

MOTOR VEHICLE DOOR HANDLE APPARATUS AND METHOD OF INSTALLATION

FIELD OF THE INVENTION

The present invention relates to door handle assemblies, and more particularly to motor vehicle door handle assemblies, manners of installing such assemblies, and elements and devices used for installing and retaining such assemblies in motor vehicle doors.

BACKGROUND OF INVENTION

The installation of a door handle assembly in a motor vehicle door through an aperture in the door is known in the art. In many designs, the door handle assembly inserts into the aperture from the outside of the door where a front plate of the door handle assembly limits the movement of insertion. The fastening of the door handle assembly to the door by a suitable retaining member typically takes place from the inner side of the door. Therefore, the inner side of the door is normally provided with an access aperture or other area for enabling the installation of the retaining member and associated hardware (e.g., nuts, screws, pins, or clips). Although common, this method of installation is cumbersome and leads to an increase in the cost of manufacture of the door assembly. Installation is often performed manually because control over elements on both sides of the door is needed. In many cases, an installer must manipulate and hold the handle assembly in place on one side of the door while manipulating and installing fasteners on the opposite side of the door. This manner of installation is time-consuming, labor-intensive, and expensive. An additional shortcoming of this design is the amount of contact between elements of the door handle assembly and the door during installation, increasing the tendency for scratching or other damage to the surface of the door.

U.S. Pat. No. 5,706,554 describes a door handle assembly installed entirely from the outside of the door. Although the disclosed device offers improvements over the prior art, the device is installed in a multiple-step process in which the installer must apply forces to the door handle assembly in multiple directions.

Specifically, a worker must grip the door handle assembly with two hands, manipulate the door handle assembly into a particular position in an aperture of the door, and then actuate the handle to activate a mechanism which engages the handle assembly to the inside of the aperture. This manner of installation therefore requires a relatively complex series of motions and forces only capable of being performed manually. Automation of such motions and forces would require expensive machinery narrowly designed for this installation task. Furthermore, the number of installation steps required increases the tendency for installation errors, assembly line delays, and quality control issues.

In light of the problems and limitations of the prior art described above, a need exists for a motor vehicle door handle assembly that is easy to install, can be installed manually or in an automated manner, can be installed from one side of a door without access from an opposite side of the door, can be quickly installed in a reduced number of motions and with a reduced number of different forces exerted by an installer, and requires less door handle assembly manipulation during the installation process.

SUMMARY OF INVENTION

In some preferred embodiments of the present invention, a fastener on a door handle assembly having a door handle is moved by actuation of the door handle into a position in which the fastener connects the door handle assembly to the door. Although the handle actuation can be toward an open or closed position of the handle, handle closure preferably generates this connection. More preferably, the handle closure is in a direction toward the door into which the handle assembly is installed. Therefore, the door handle assembly can be both installed and connected by forces directed substantially toward the door. In such cases, the handle assembly preferably has a fastener for retaining the handle in an open position until the handle is actuated (after installation of the door handle assembly in the door). This feature significantly simplifies and speeds door handle installation and permits door handle installation to be more readily automated.

The door handle is preferably capable of transmitting door handle actuation force to the fastener in order to move the fastener as described above. In one preferred embodiment, this force is transmitted by directly or indirectly camming the handle against a sliding member to which the fastener is connected. In another embodiment, this force is transmitted by pulling a sliding member with links directly or indirectly connected to the handle. Still other elements and structures capable of transmitting actuation force from the handle to the fastener are possible, each of which falls within the spirit and scope of the present invention.

Although not required to practice the invention, the movable fastener preferably connects with a second fastener connected to the door handle assembly or to the door. Therefore, when the movable fastener is moved by actuation of the handle, the movable fastener connects with the second fastener to secure the door handle assembly to the door. A number of different fastener types can be employed in the present invention. In some highly preferred embodiments, the fasteners are interconnectable clips and studs.

The movable fastener in some preferred embodiments is attached to a sliding member on a base of the door handle assembly. In this manner, the fastener can be moved by sliding the sliding member, such as by camming the sliding member or by pulling the sliding member as described above.

As used herein and in the appended claims, the term "actuate" with reference to a door handle does not indicate or imply movement of the handle in any particular direction or to any particular position. Accordingly, movement of a door handle from a closed position to an open position and movement of a door handle from an open position to a closed position are both considered to be "actuation" of the door handle.

The present invention reduces the time required to install a door handle assembly by eliminating complex, multi-directional movements of the door handle assembly during insertion and awkward, multi-directional movements to connect the door handle assembly and the motor vehicle door. In addition to the greater ability to automate the installation and connection process as described above, a second access to the door handle assembly (e.g., access from a side of the door opposite the installation side) is not needed to secure the door handle assembly to the door.

Further objects and advantages of the present inventive motor vehicle door handle assembly, together with the organization and manner of operation thereof, will become apparent from the following detailed description of the invention when taken in conjunction with the accompanying drawings, wherein like elements have like numerals throughout the drawings.

BRIEF DESCRIPTION OF DRAWINGS

The present inventive door handle assembly is further described with reference to the accompanying drawings, which show preferred embodiments. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the invention.

In the drawings, wherein like numerals indicate like parts.

DETAILED DESCRIPTION

Figure 1:
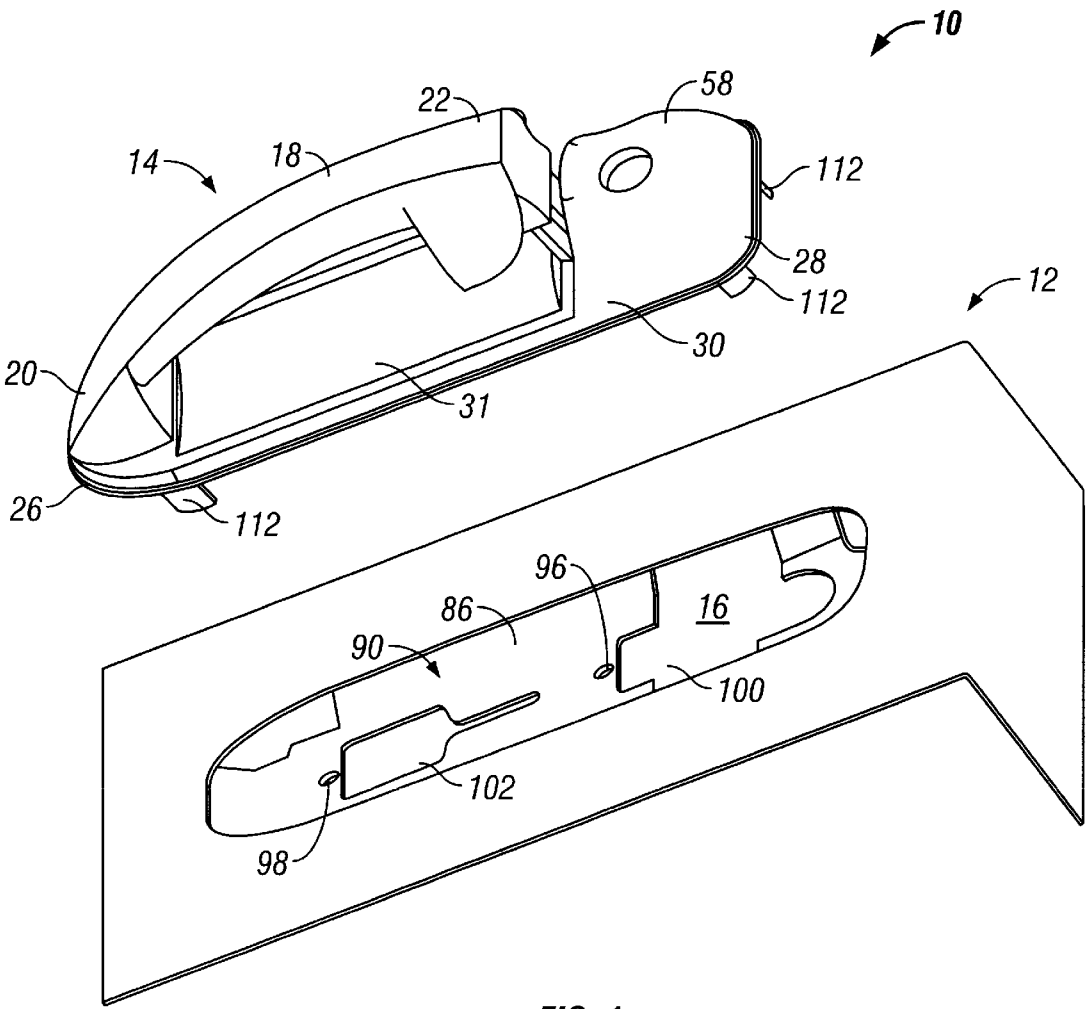
FIG. 1 is a front perspective view of a vehicle door handle assembly according to a first preferred embodiment of the present invention, shown prior to installation in a door aperture.

FIGS. 1–11 illustrate a motor vehicle door assembly 10 according to a preferred embodiment of the present invention. The motor vehicle door assembly 10 includes a motor vehicle door 12 and door handle assembly 14. The motor vehicle door 12 and door handle assembly 14 are adapted to enable the door handle assembly 14 to be inserted and secured within an aperture 16 in the door 12 by moving the door handle assembly 14 into the aperture 16 and by actuating a handle 18 of the door handle assembly 14. Preferably (though not necessarily), the door handle assembly 14 is secured within the aperture 16 by actuation of the handle 18 in a direction substantially toward the door 12 during or after insertion of the door handle assembly 14 in the aperture 16. In other embodiments (not illustrated), the door handle assembly 14 is secured within the aperture 16 by actuation of the handle 18 in a direction away from the door 12 during or after insertion of the door handle assembly 14 in the aperture 16.

Assembly attachment by handle actuation toward the door 12 is preferred because the door handle assembly 14 is inserted in the same general direction as the force causing the door handle assembly 14 to be secured within the aperture 16 (i.e., toward the door 12). Insertion of the door handle assembly 14 into the aperture 16 and attachment of the door handle assembly 14 to the door 12 is therefore possible through a single motion, or at least a motion in which forces are efficiently and quickly exerted in a common general direction with a reduced amount of door handle assembly manipulation.

Figure 2:
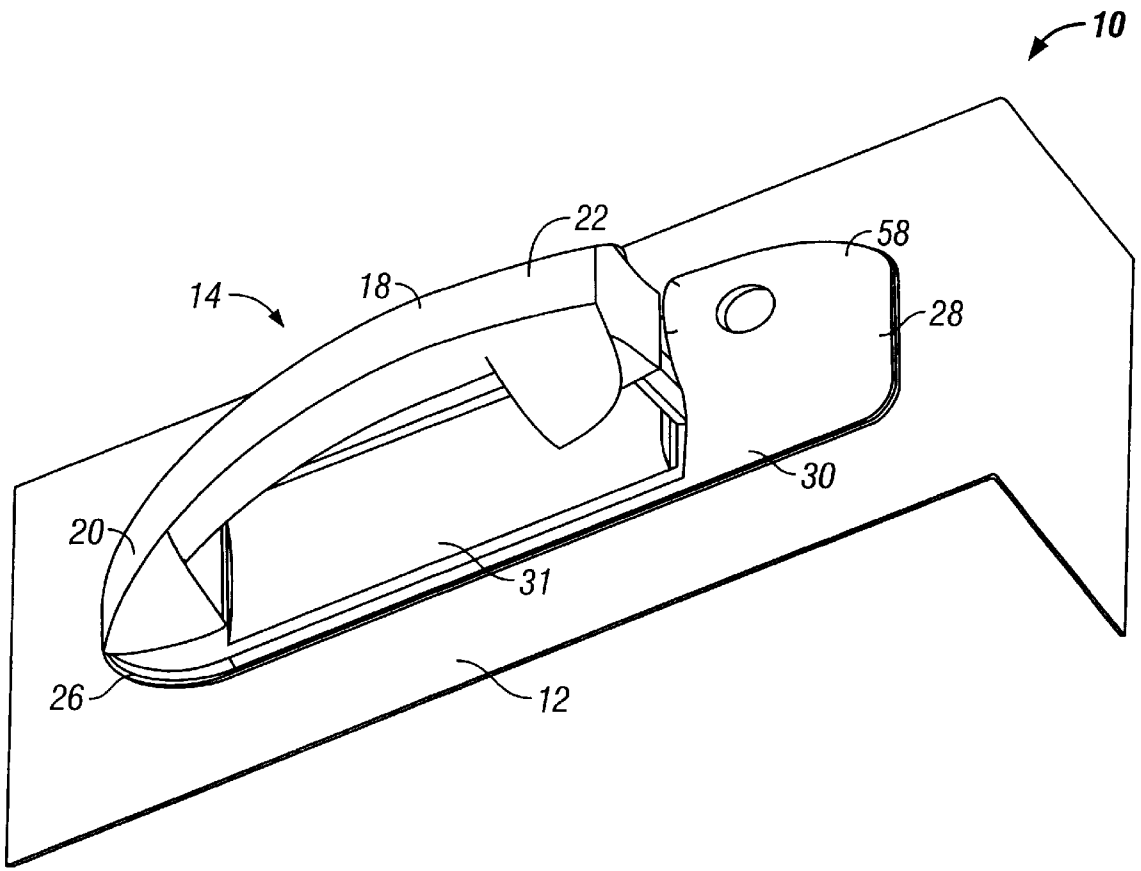
FIG. 2 is a front perspective view of the vehicle door handle assembly illustrated in FIG. 2, shown inserted in the door aperture.
Figure 3:
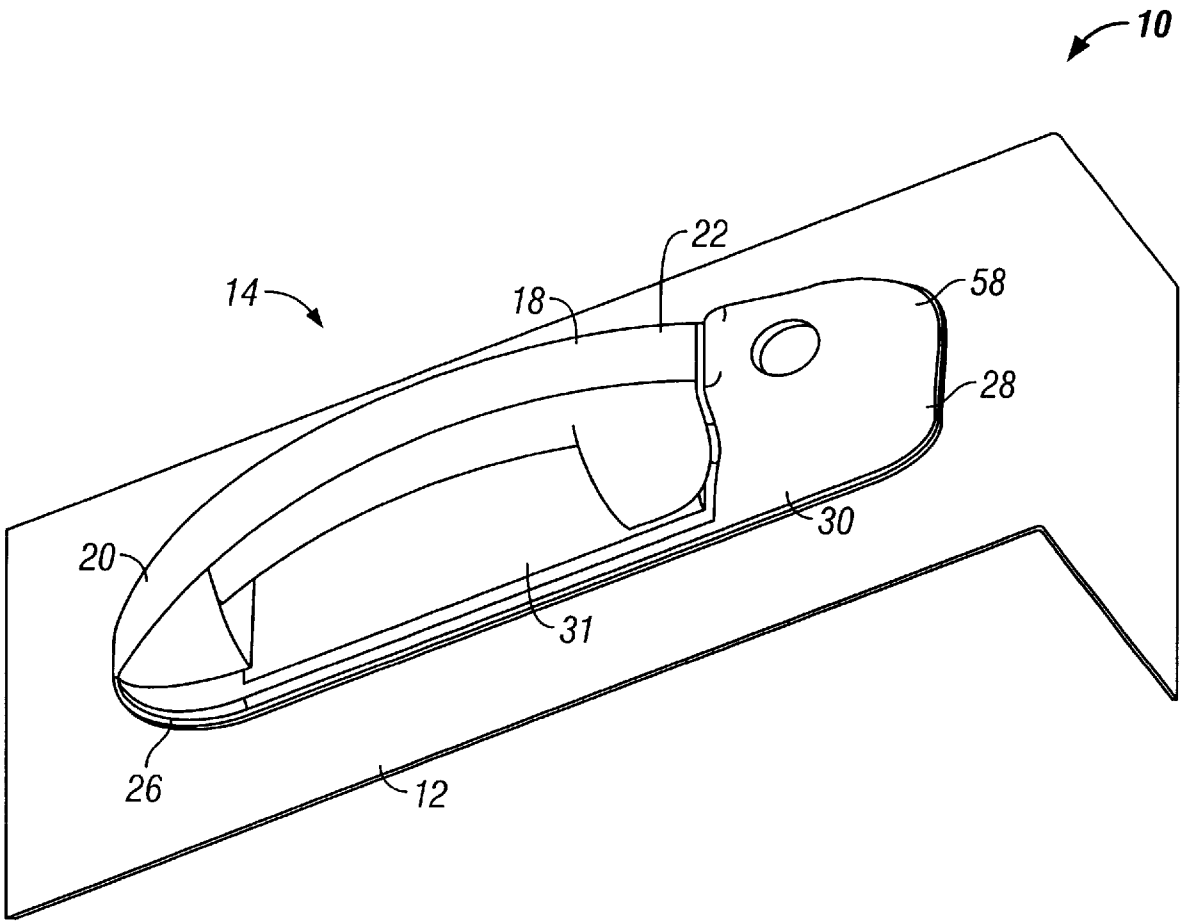
FIG. 3 is a front perspective view of the vehicle door handle assembly illustrated in FIGS. 1 and 2, shown inserted and secured in the door aperture.
Figure 4:
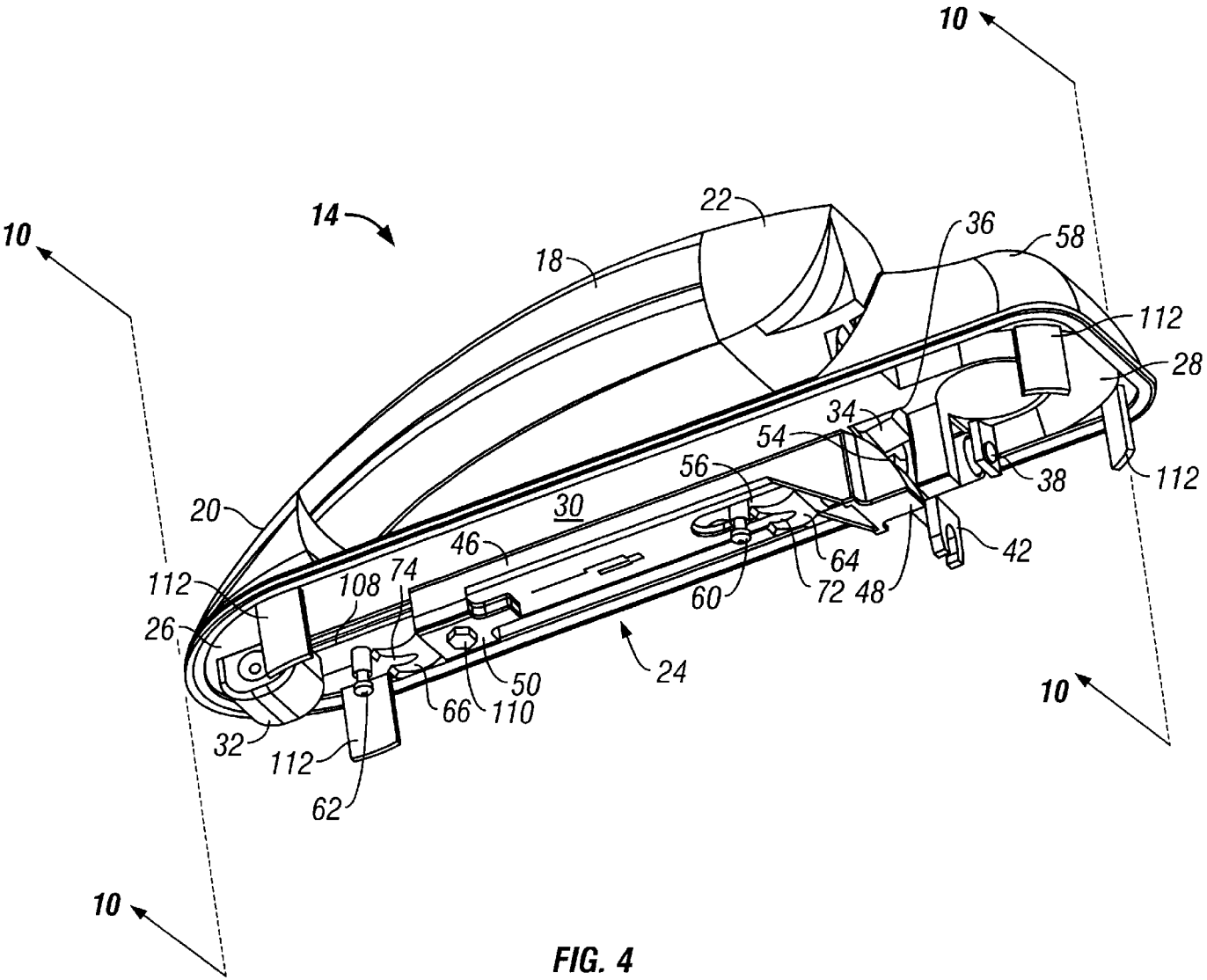
FIG. 4 is a rear perspective view of the vehicle door handle assembly illustrated in FIGS. 1–3, shown prior to installation in a door aperture.
Figure 5:
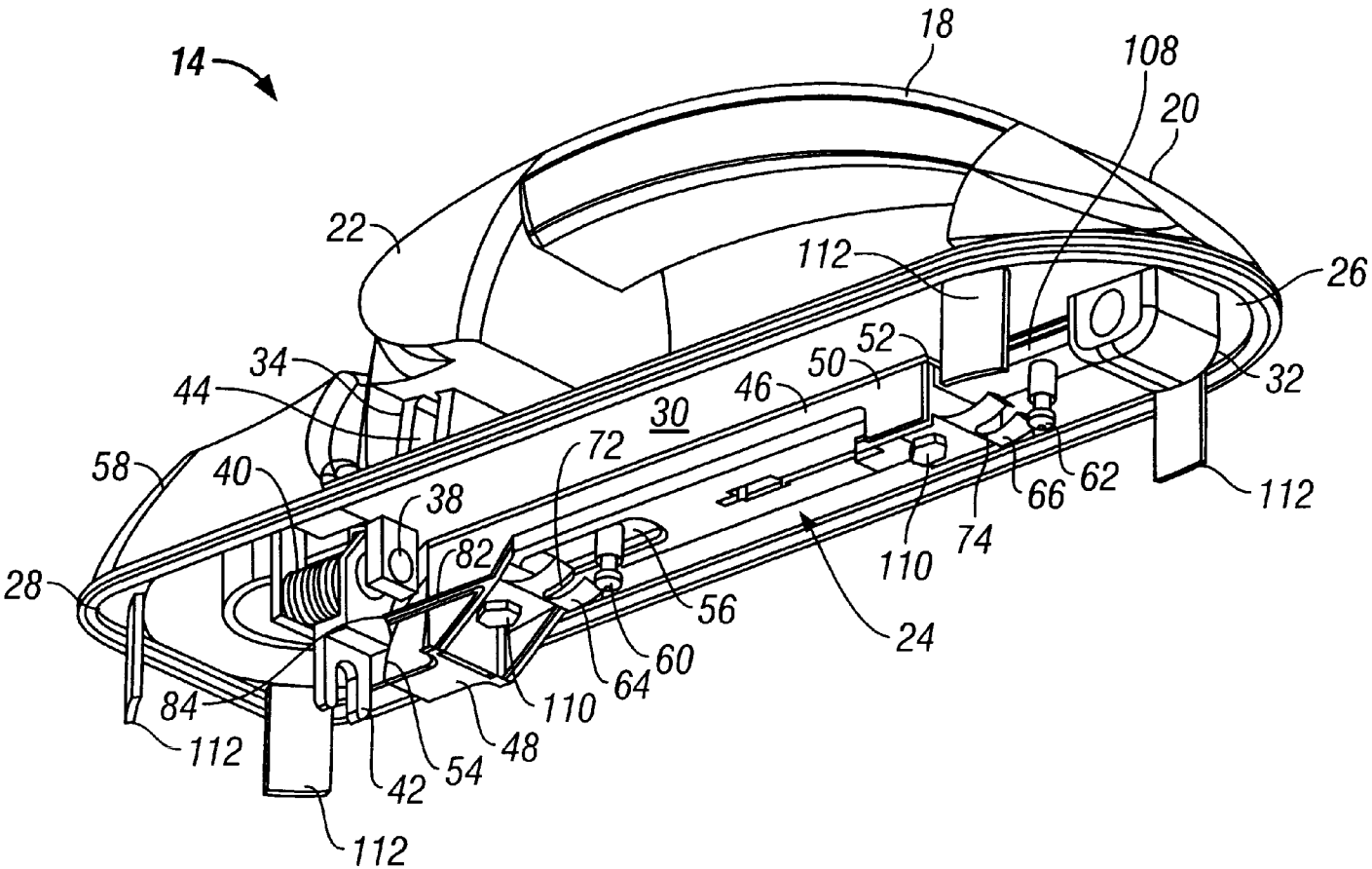
FIG. 5 is another rear perspective view of the vehicle door handle assembly illustrated in FIGS. 1–3, shown prior to installation in a door aperture.
Figure 6:
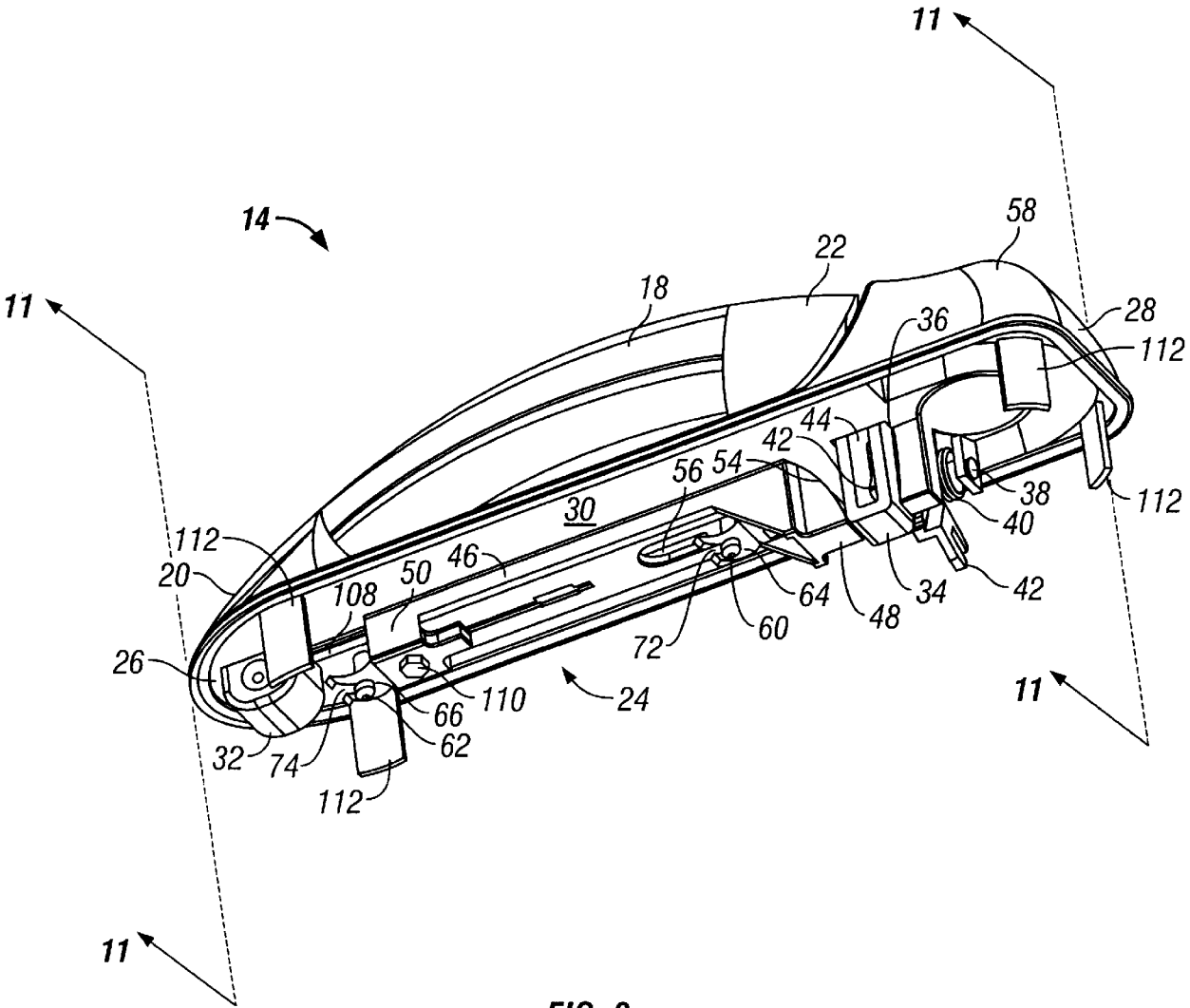
FIG. 6 is a rear perspective view of the vehicle door handle assembly illustrated in FIGS. 1–5, shown actuated to a state in which the assembly is secured to a door (not shown)
Figure 7:
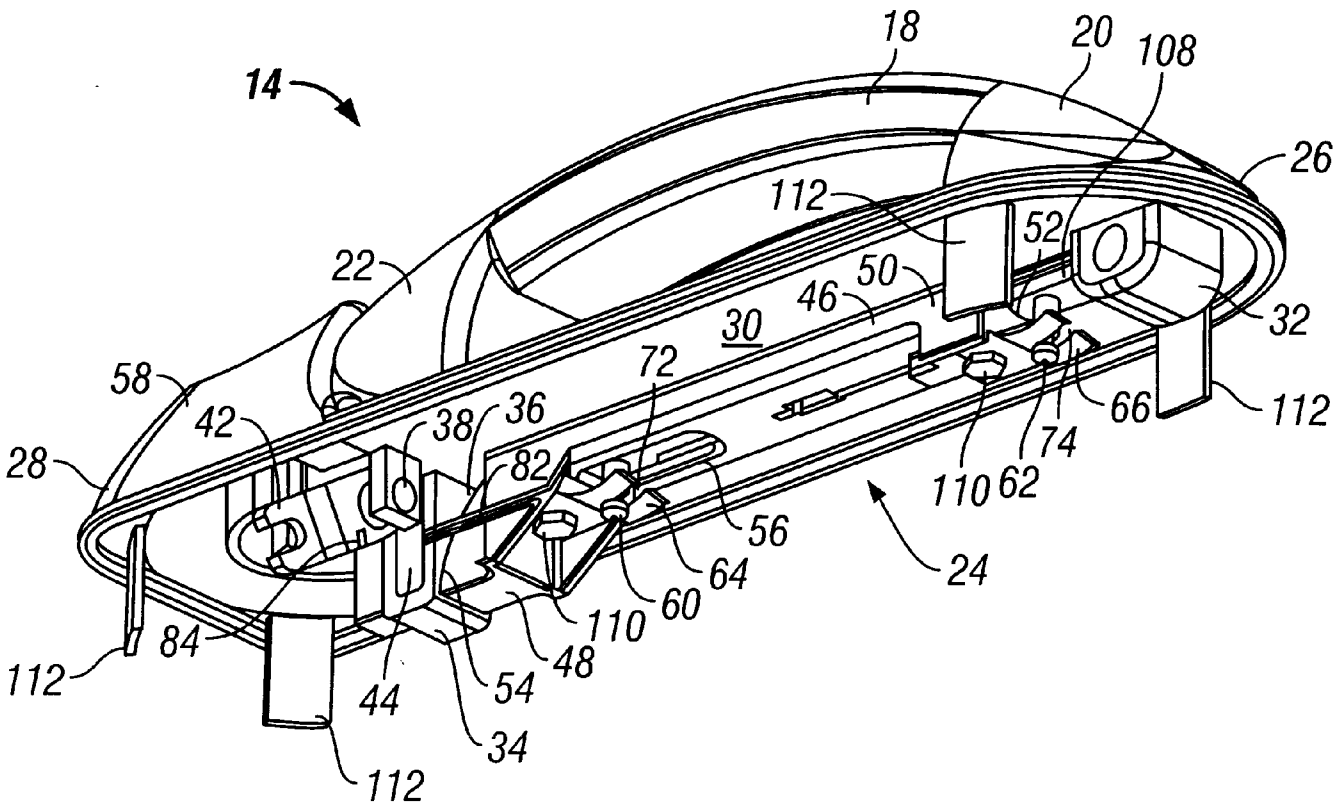
FIG. 7 is another rear perspective view of the vehicle door handle assembly illustrated in FIGS. 1–5, shown actuated to a state in which the assembly is secured to a door (not shown)
Figure 8:
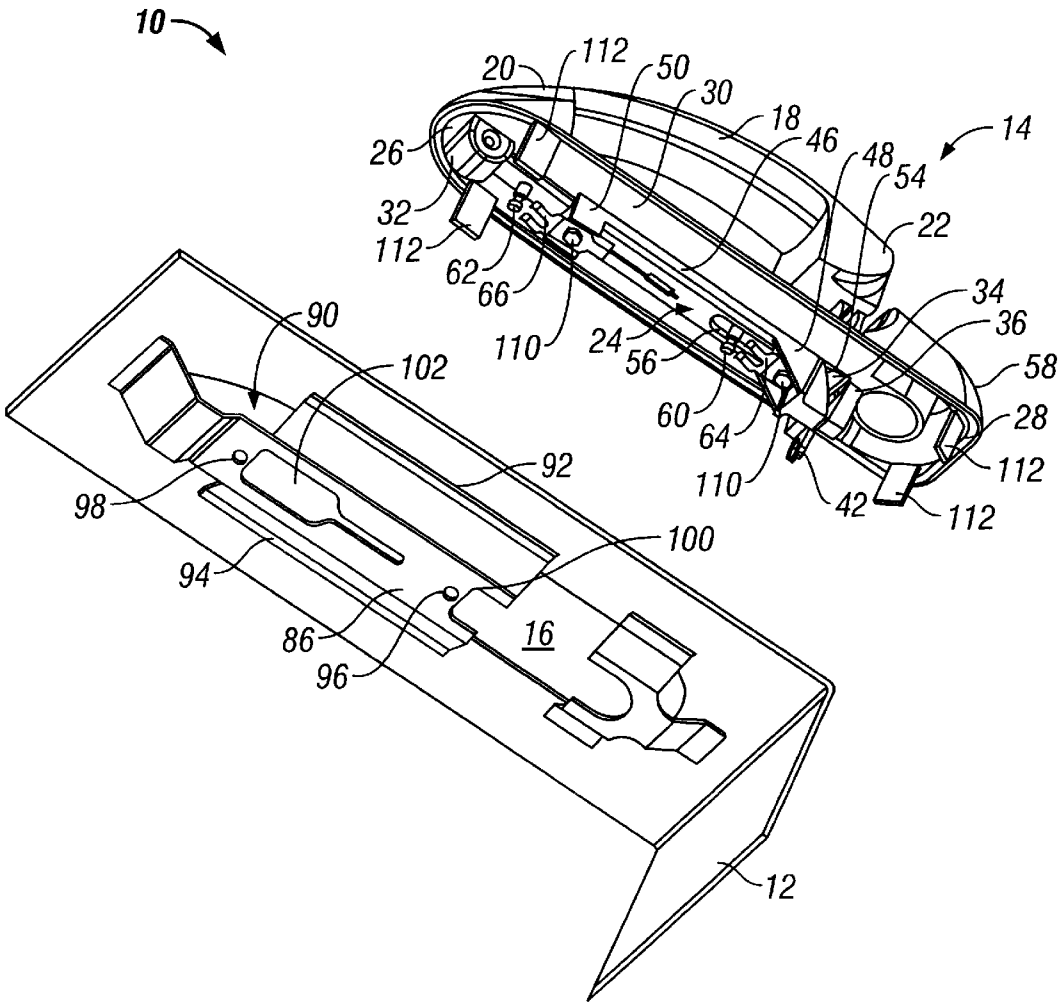
FIG. 8 is a rear perspective view of the vehicle door handle assembly illustrated in FIGS. 1–7, shown prior to installation in a door aperture.
Figure 9:
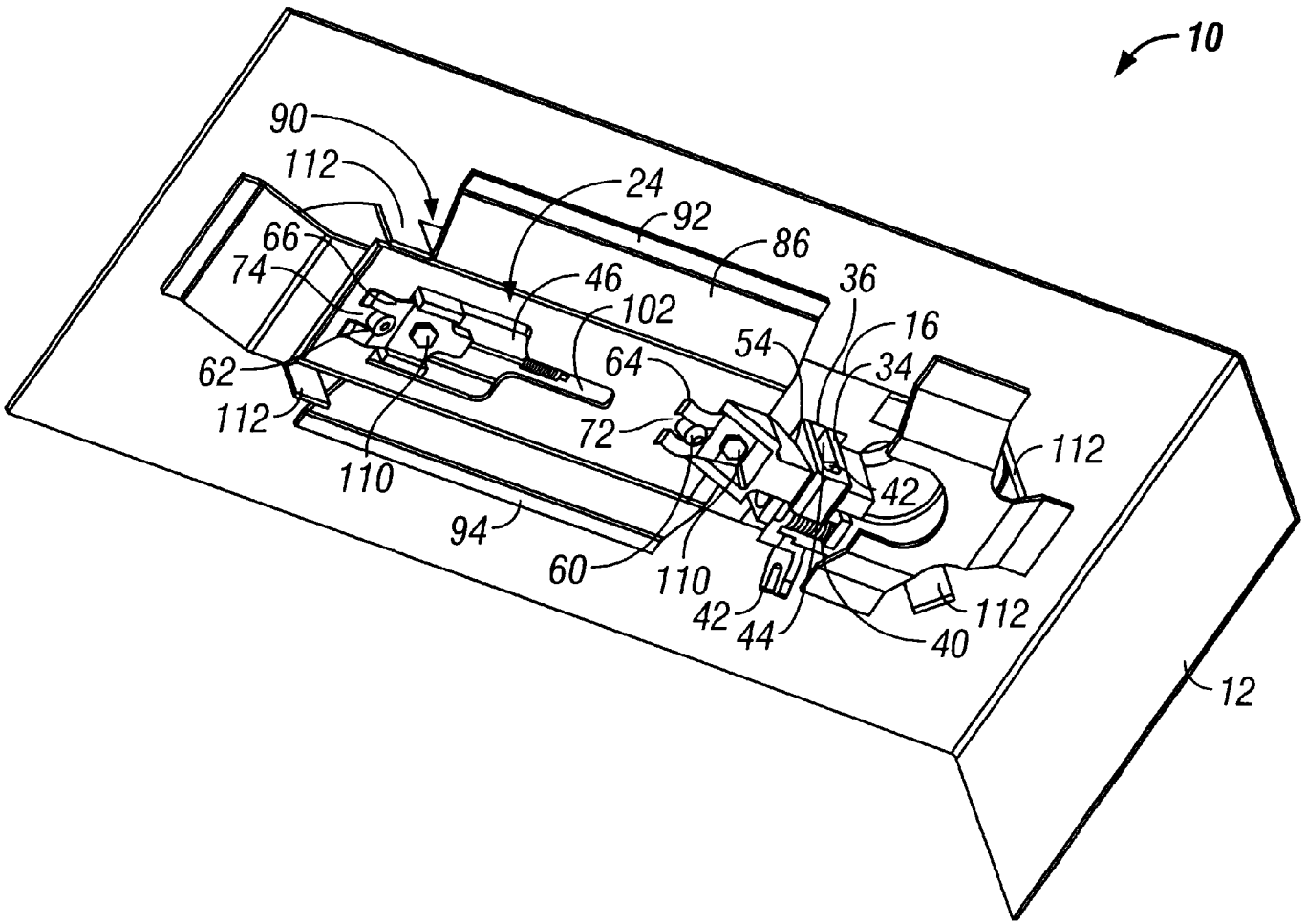
FIG. 9 is a rear perspective view of the vehicle door handle assembly illustrated in FIG. 6, shown with the vehicle door.
Figure 10:
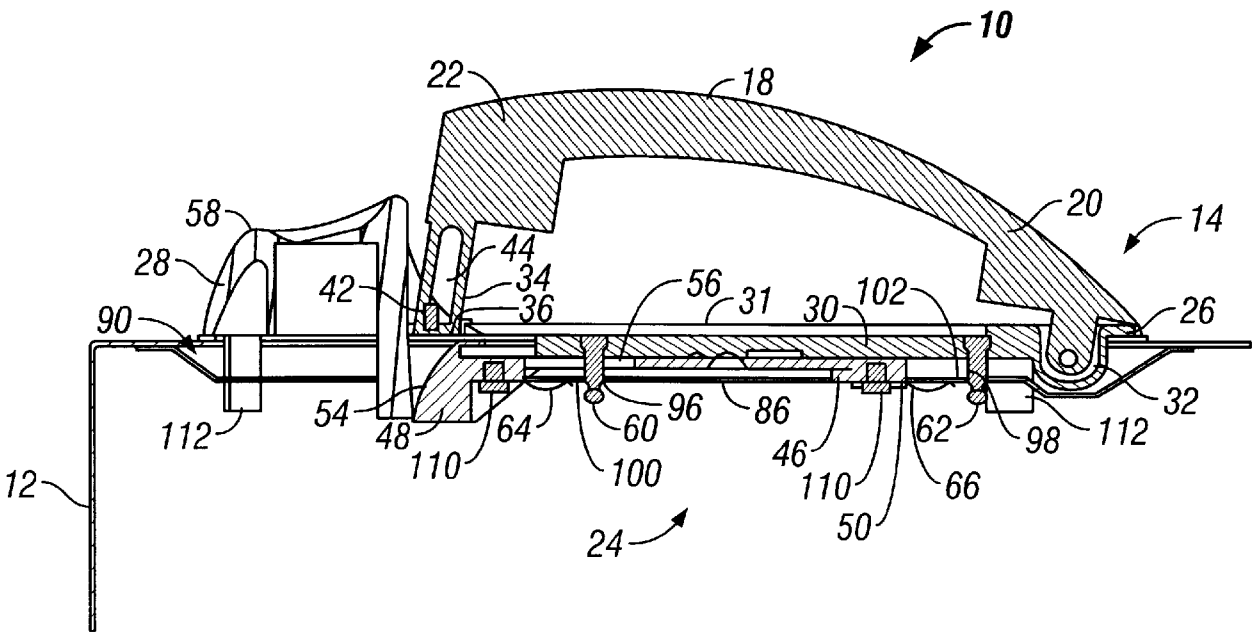
FIG. 10 is a cross-sectional side view of the vehicle door handle assembly illustrated in FIGS. 1–9, taken along lines 10—10 of FIG. 4 and shown prior to being secured in a door aperture.
Figure 11:
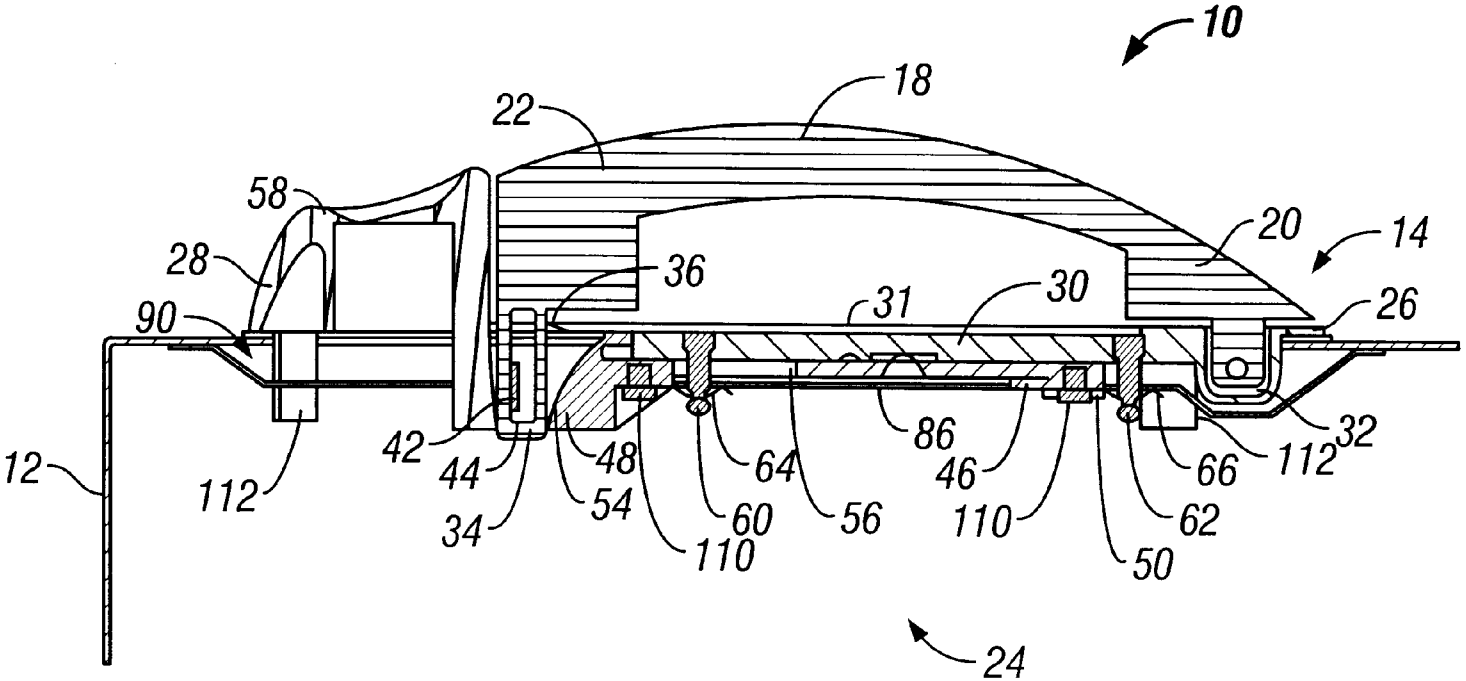
FIG. 11 is a cross-sectional side view of the vehicle door handle assembly illustrated in FIGS. 1–10, taken along lines 11—11 of FIG. 6 and shown after being secured in a door aperture.
Figure 12:
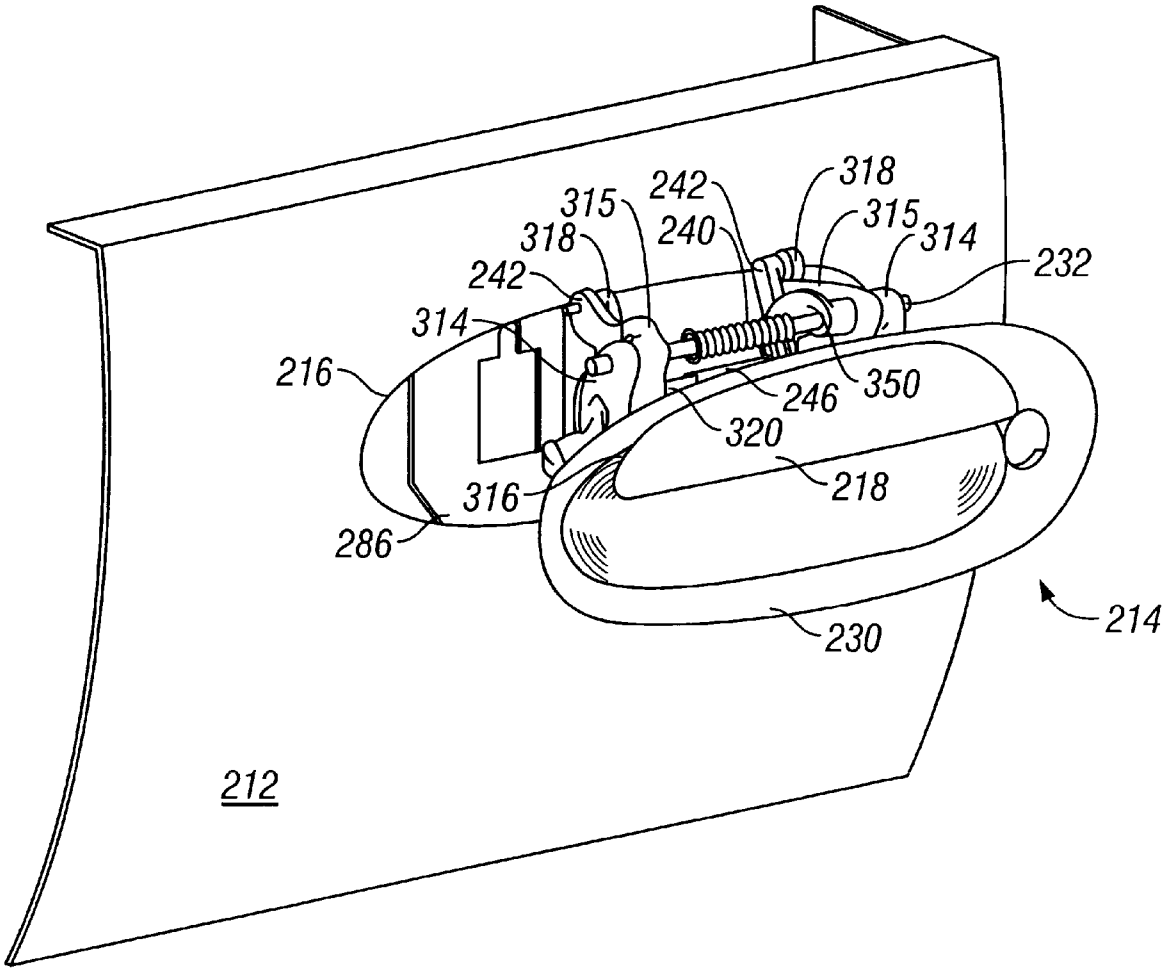
FIG. 12 is a front perspective view of a vehicle door handle assembly according to a second preferred embodiment of the present invention, shown prior to installation in a door aperture.
Figure 13:
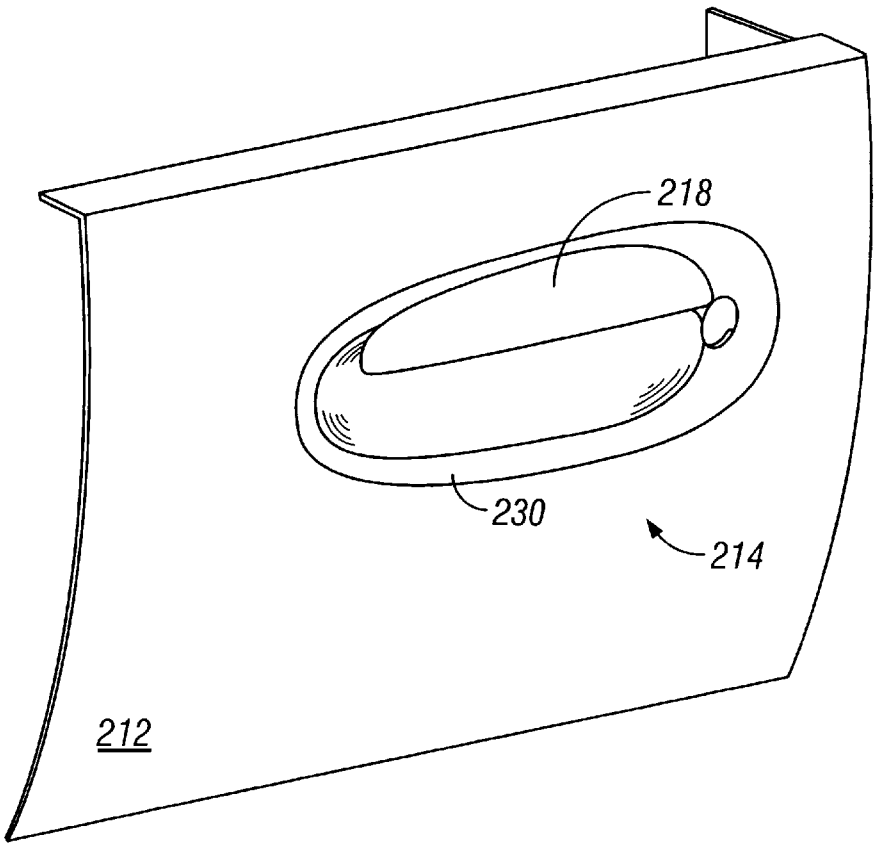
FIG. 13 is a front perspective view of the vehicle door handle assembly illustrated in FIG. 12, shown inserted in the door aperture.
Figure 14:
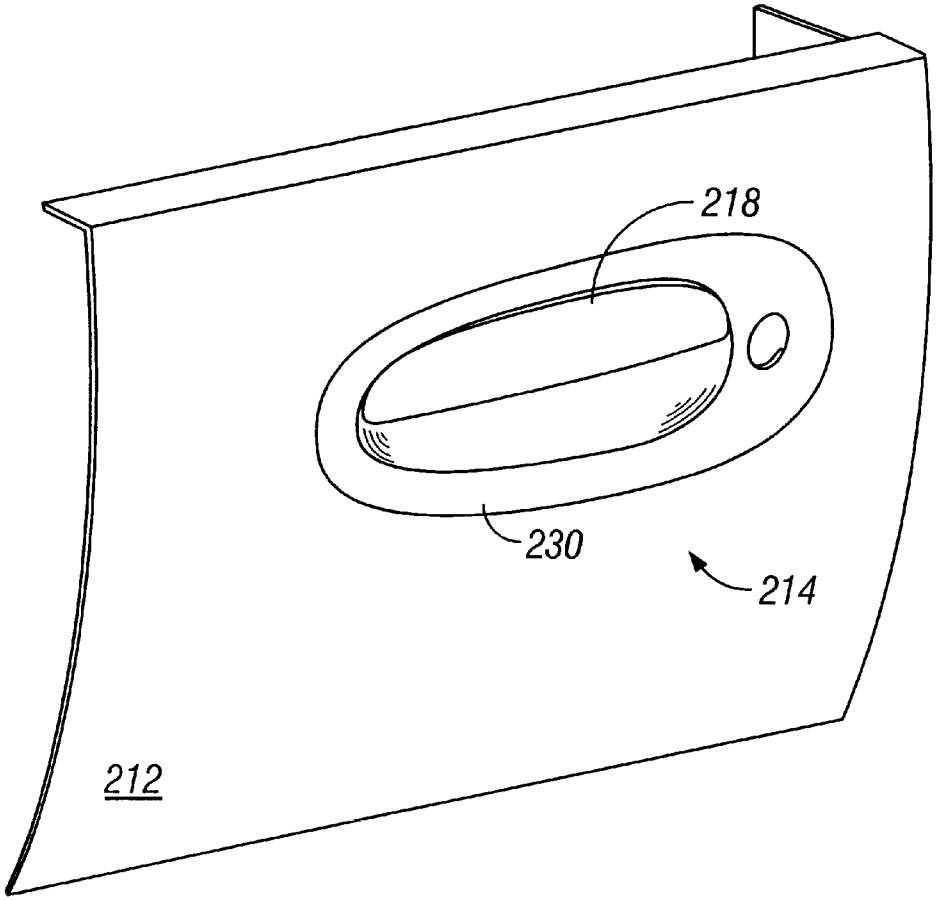
FIG. 14 is a front perspective view of the vehicle door handle assembly illustrated in FIGS. 12 and 13, shown inserted and secured in the door aperture.
Figure 15:
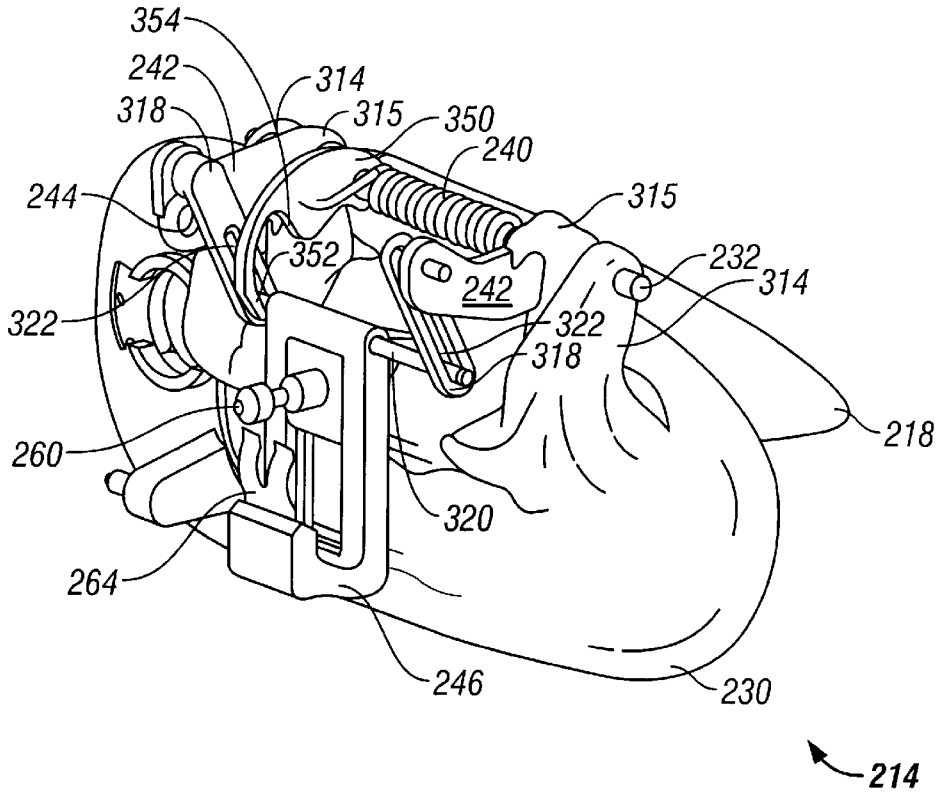
FIG. 15 is a rear perspective view of the vehicle door handle assembly illustrated in FIGS. 12–14, shown prior to installation in a door aperture.
Figure 16:
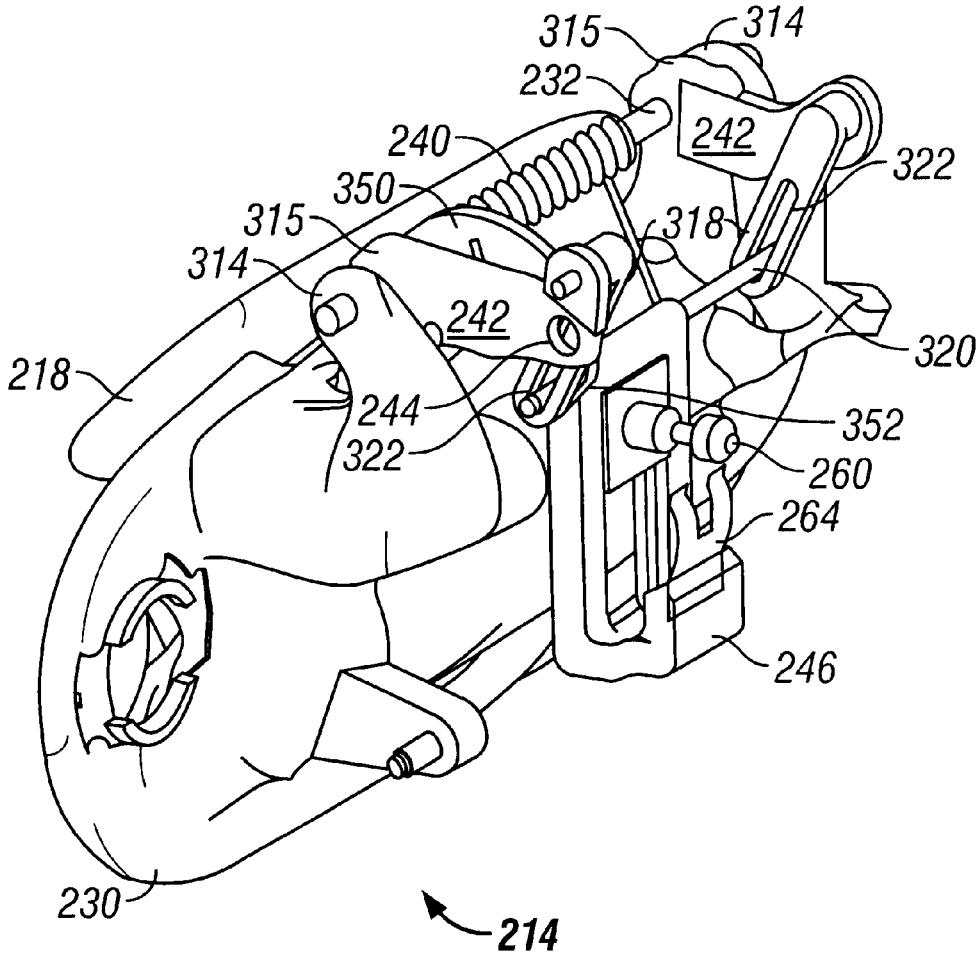
FIG. 16 is another rear perspective view of the vehicle door handle assembly illustrated in FIGS. 12–14, shown prior to installation in a door aperture.
Figure 17:
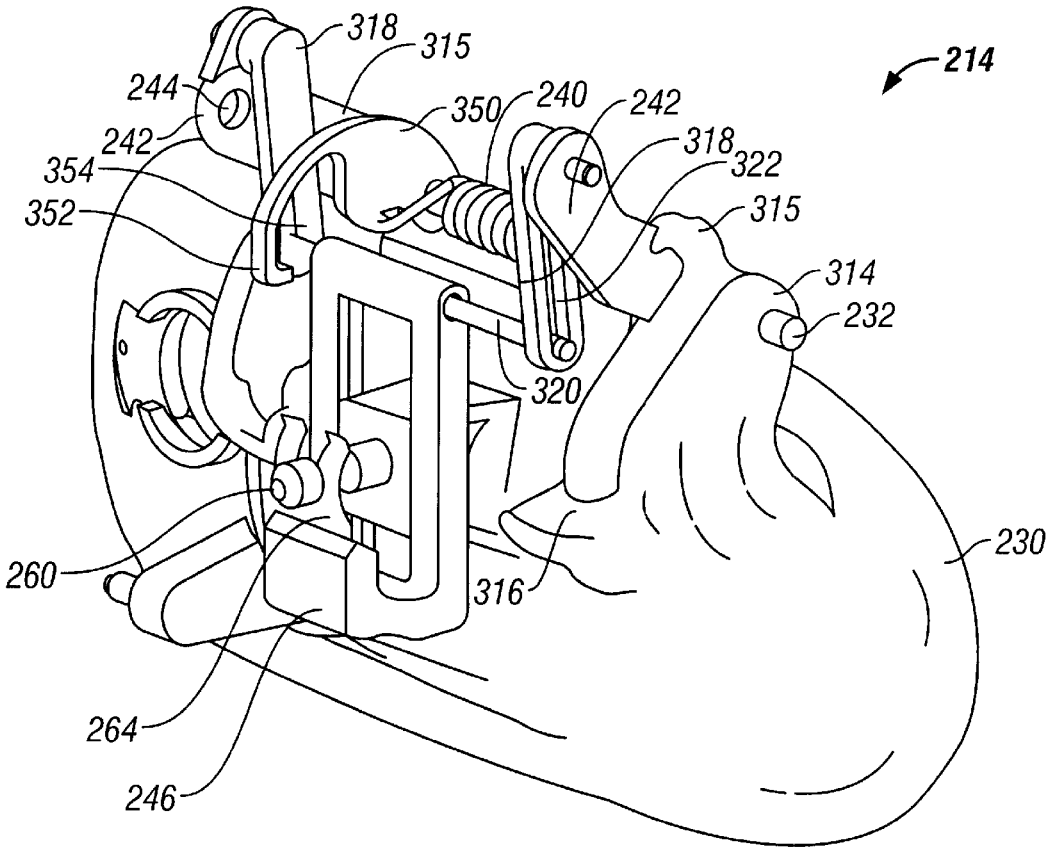
FIG. 17 is a rear perspective view of the vehicle door handle assembly illustrated in FIGS. 12–16, shown actuated to a state in which the assembly is secured to a door (not shown)
Figure 18:
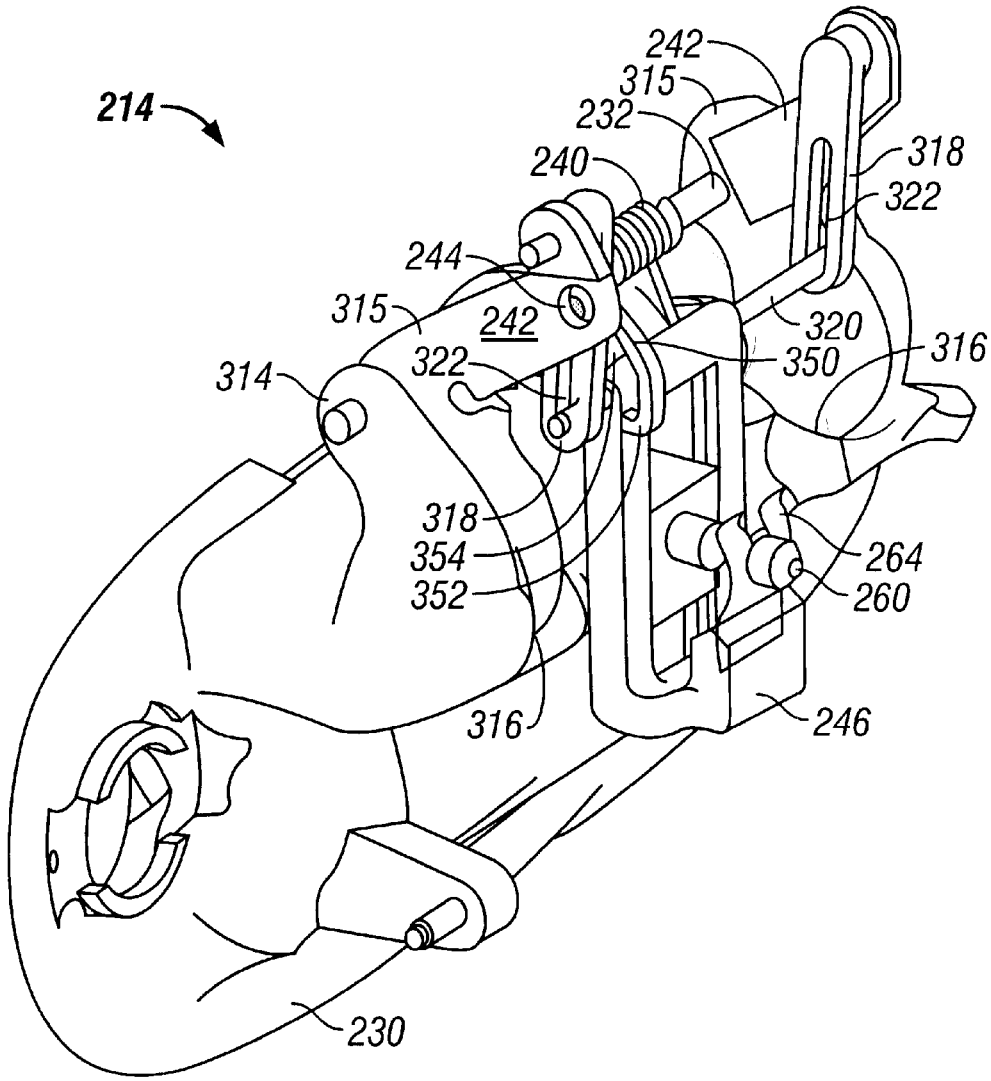
FIG. 18 is another rear perspective view of the vehicle door handle assembly illustrated in FIGS. 12–16, shown actuated to a state in which the assembly is secured to a door (not shown)
Figure 19:
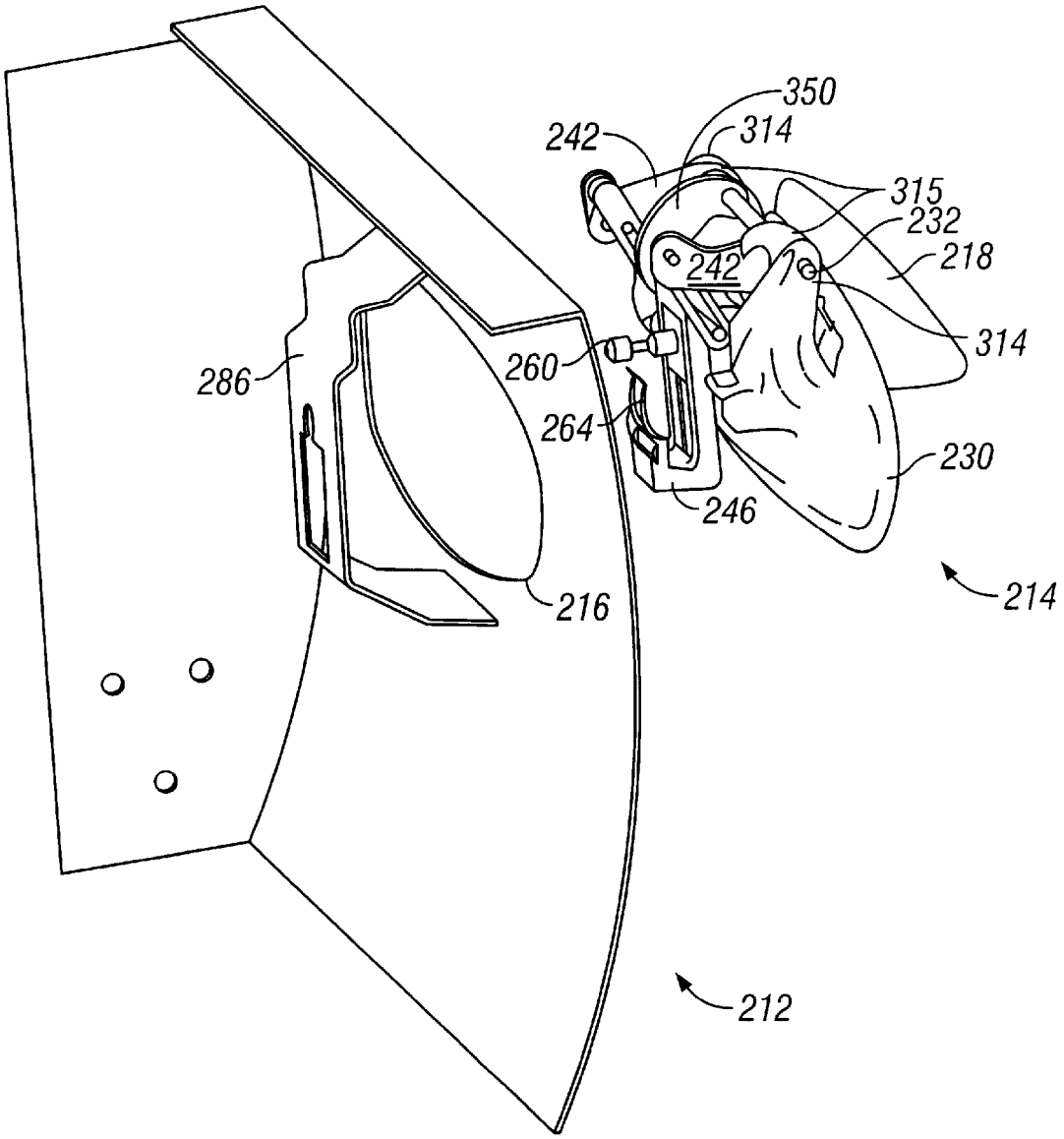
FIG. 19 is a rear perspective view of the vehicle door handle assembly illustrated in FIGS. 1–18, shown prior to installation in a door aperture.
Figure 20:
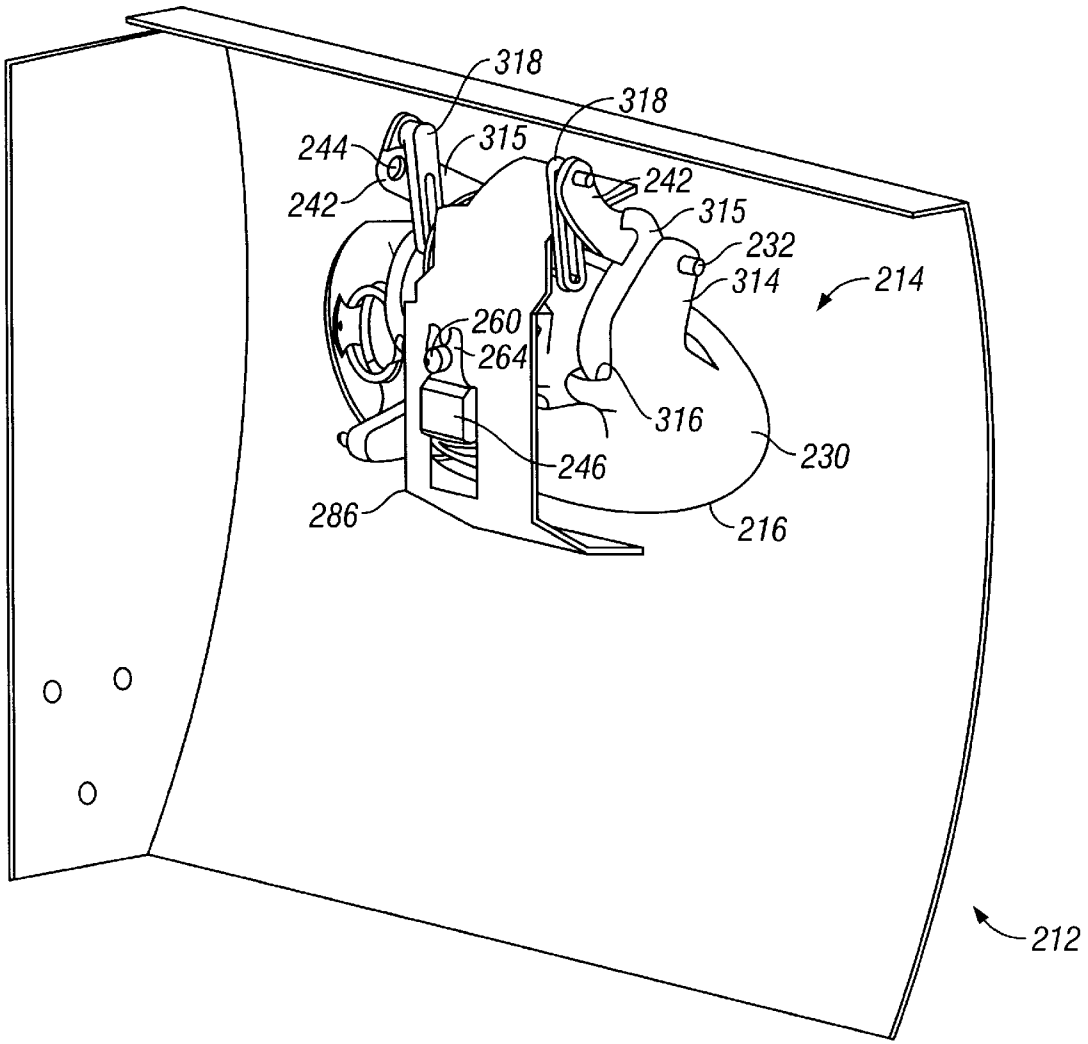
FIG. 20 is a rear perspective view of the vehicle door handle assembly illustrated in FIG. 17, shown with the vehicle door.
Figure 21:
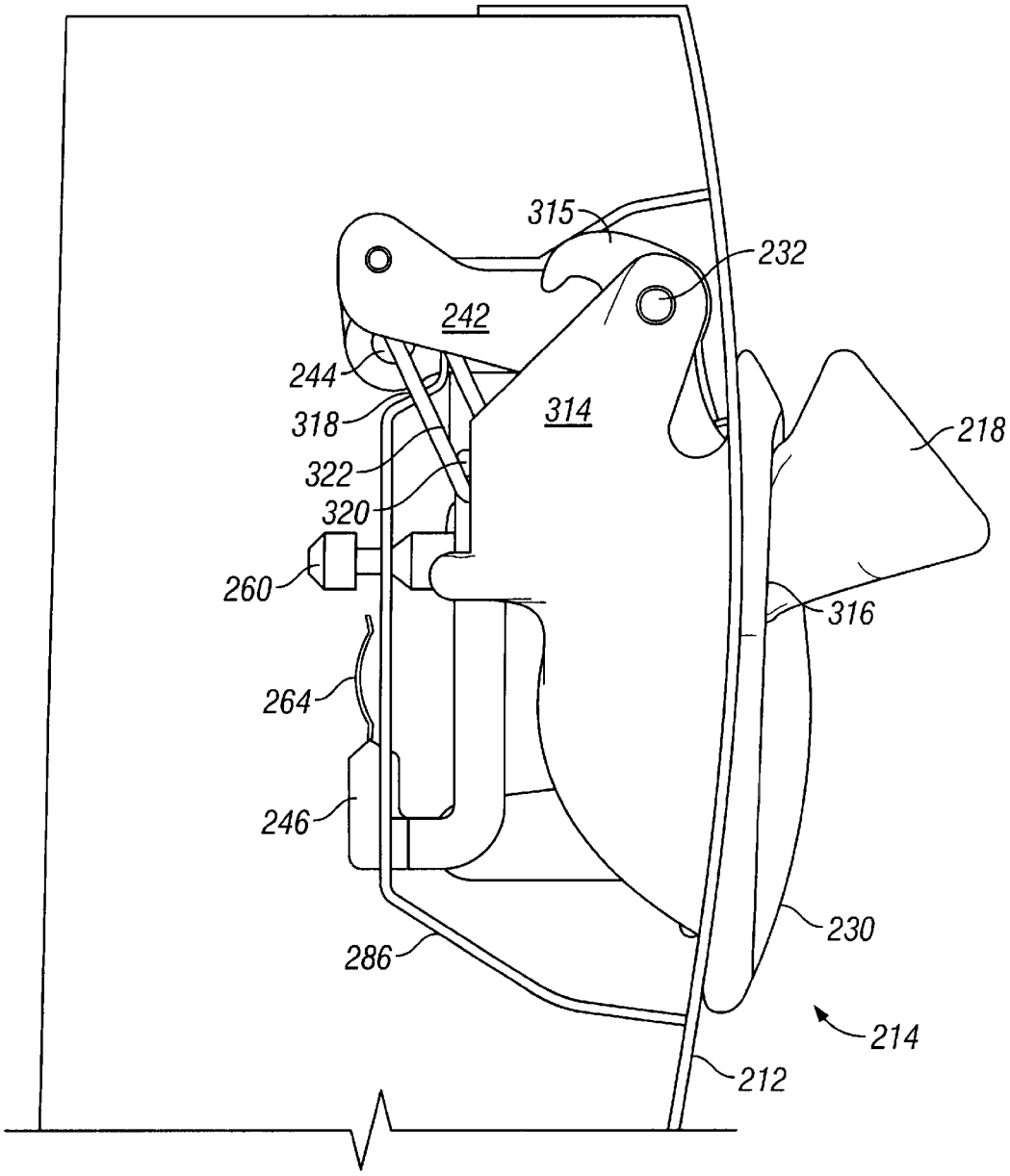
FIG. 21 is a side elevational view of the vehicle door handle assembly illustrated in FIGS. 12–20, shown prior to installation in a door aperture.
Figure 22:
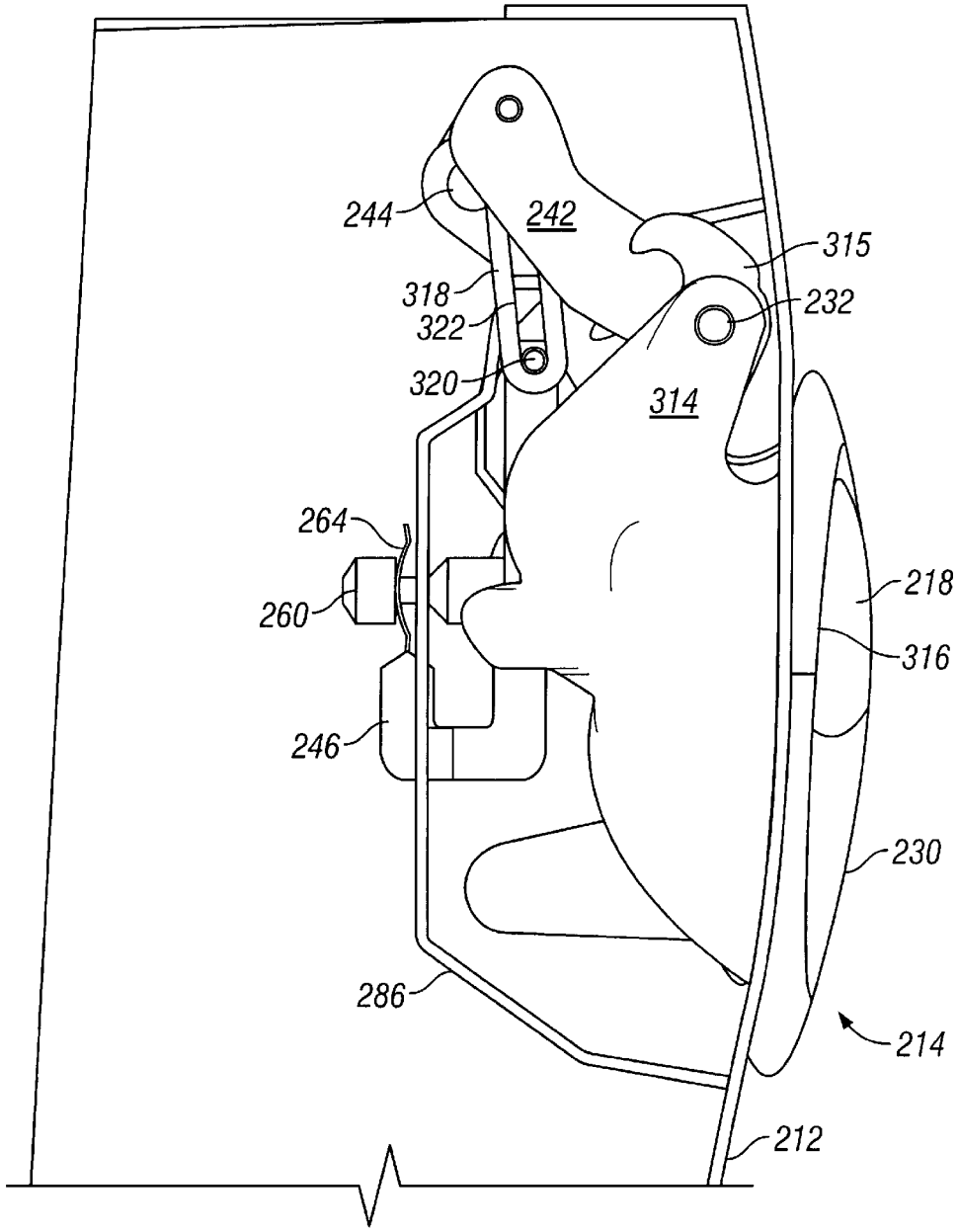
FIG. 22 is a side elevational view of the vehicle door handle assembly illustrated in FIGS. 12–20, shown actuated to a state in which the assembly is secured to a door (not shown).

In some preferred embodiments, the handle 18 is held in an open position prior to and during insertion of the door handle assembly 14 in the aperture 16 of the door 12 (see FIGS. 1 and 2). During insertion of the door handle assembly 14, the door handle assembly 14 is aligned with the aperture 16 and is inserted through the aperture 16 by moving the assembly 14 along an insertion path. Thereafter, force is applied to the handle 18 in a direction toward the door 12 to close the door handle 18. This force is transmitted to a mechanism or element (described in greater detail below) which secures the door handle assembly 14 in place within the aperture 16. One having ordinary skill in the art will appreciate that different types of door handles exert different types of forces when actuated. Two different types of door handles are illustrated in the figures: a pull-type handle illustrated in FIGS. 1–11 and a paddle or lift-type handle illustrated in FIGS. 12–22. In the various embodiments of the present invention, at least part of the forces from handle actuation are transmitted to actuate the mechanism or element which secures the door handle assembly 14 with respect to the door 12.

As will be described in greater detail below, the door handle assembly 14 has an engagement assembly 24 which, when actuated, engages the door handle assembly 14 to the door 12, thereby securing the door handle assembly 14 to the door 12. The engagement assembly 24 can take a number of different forms, two of which are illustrated in FIGS. 1–22. Also, force from actuation of the handle 18 can be transmitted to the engagement assembly 24 in a number of different manners, two of which are illustrated in the figures.

With reference first to FIGS. 1–11, actuation of the handle 18 causes the handle 18 (or an element connected thereto) to cam against the engagement assembly 24. This camming motion causes the engagement assembly 24 to move into a position in which the engagement assembly 24 is attached to the door 12.

The door handle assembly 14 illustrated in FIGS. 1–11 preferably includes a base 30 having first and second ends 26, 28 and a handle 18 having first and second ends 20, 22 corresponding to the first and second ends 26, 28 of the base. The first end 20 of the handle 18 is preferably rotatably connected to the first end 26 of the base 30 by a hinge 32. The handle 18 also preferably has a camming portion 34 integral with or attached to the handle 18. This camming portion 34 can be any shape capable of exerting a camming force upon the engagement assembly 24 as described above. By way of example only, the camming portion 34 can be wedge-shaped, block-shaped, or have a curved profile. In the illustrated preferred embodiment, the camming portion 34 is an elongated element extending from the handle 18 and integral therewith or connected thereto in any conventional manner. Preferably, the camming portion 34 of the handle 18 extends through an aperture 36 in the base member 30. Although the camming portion 34 can be located at different positions along the handle 18, the camming portion is preferably located on the second end 22 of the handle 18.

In some preferred embodiments, a housing 58 for a cylinder lock can be included on the base member 30, can be formed as part of the base member 30 or can be a separate element connected to the base member 30 in any conventional manner, and can be located in any desired position on the base member 30. The housing 58 in the embodiment illustrated in FIGS. 1–11 is formed as part of the base member 30 and is located at the second end 28 of the base member 30. The handle 18 and top surface 31 of the base member 30 preferably define part of the exterior of the motor vehicle door 12 when installed therein, and are therefore preferably given an aesthetically pleasing appearance.

The handle 18 of the door handle assembly 14 is capable of transmitting actuation force to a latch (not shown) in order to release the latch when in its unlocked state. This transmission of force can be performed in a number of manners well known to those skilled in the art. For example, a cable, rod, lever, or other element can be directly or indirectly connected in any conventional manner to the handle 18 and to an input of the latch, whereby force from actuation of the handle is transmitted through the cable, rod, lever, or other element to the latch. In the illustrated preferred embodiment shown in FIGS. 1–11, the handle 18 is connected to a bracket 42 which responds to handle actuation by pivoting about a pivot 38 secured with respect to the base member 30. Preferably, the bracket 42 is connected to the camming portion 34 of the handle 18, such as by being received within an aperture 44 in the camming portion 34 as shown in the figures, by being attached to the camming portion 34 by one or more fasteners (e.g., rotatably, slidably, or rigidly attached thereto), and the like. However, the bracket 42 can be actuated by any other portion of the handle 18 as desired. For example, a cable, rod, lever, or other element can be connected to the bracket 42 and can be pulled or pushed by rotation of the handle 18. Still other mechanisms and assemblies for connecting the handle 18 to the door latch are possible and fall within the spirit and scope of the present invention.

In order to keep the handle 18 in a closed position when not actuated by a user, the door handle assembly 14 preferably employs a spring 40 on the pivot 38. The spring 40 is preferably connected between the base member 30 and the bracket 42, and therefore biases the handle 18 by exerting rotational force upon the bracket 42 which exerts a closing force upon the handle 18. An end of the spring 40 can be received within a notch or aperture in the bracket 42 or can be directly or indirectly connected to the bracket 42 in any other manner, such as by one or more screws, rivets, or other conventional fasteners, by welding or brazing, and the like. Alternatively, the spring 40 can be operatively connected in such manners to any part of the handle 18 in order to exert the desired closing force upon the handle 18. By way of example only, the spring 40 can be connected to the hinge 32 of the handle, can be connected between the base member 30 and the body of the handle 18, can be connected to the base and have an end extending into the aperture 44 of the camming portion 34, and the like.

It will be appreciated by one having ordinary skill in the art that any type of biasing element can be used to bias the handle 18 toward its closed position. Such biasing members include without limitation extension or compression coil springs, torsion springs, leaf springs, and other types of springs, elastic bands, or a take-up reel connected to the handle 18 by a wire or cable. Each type of biasing member can be operatively connected to bias the handle 18 in any conventional manner, such as by being mounted upon a pivot as shown in FIGS. 4–7, 10, and 11, by being connected to the base member 30 in any of the manners mentioned above with reference to the connection between the spring 40 and the bracket 42, and the like. Still other types of biasing elements and manners of connecting such biasing elements to the handle 18 in order to bias the handle 18 toward its closed position are possible, each one of which falls within the spirit and scope of the present invention.

As mentioned above, the door handle assembly 14 has an engagement assembly 24 that can be actuated to secure the door handle assembly 14 to the door 12. In the illustrated preferred embodiment shown in FIGS. 1–11, this engagement assembly 24 is a sliding member 46 connected to the base member 30. The sliding member 46 has a first end 48 and a second end 50, and is capable of being shuttled toward the first end 26 of the base member 30. This motion is enabled by a sliding connection between the sliding member 46 and the base member 30. The base member 30 can be slidably connected to the sliding member 46 in a number of different manners. Preferably, sliding member 46 has one or more rails 52 slidably connected to a track 108 on the base member 30. The track 108 and rails 52 are preferably integrally formed with the base member 30 and sliding member 46, respectively, but can instead be separate elements connected to the base member 30 and the sliding member 46 in any conventional manner. Alternatively, the track 108 could be located on the sliding member 46 with the rails 52 being located on the base member 30.

The track 108 and rails 52 can take any shape desired, but preferably are engaged to retain the sliding member 46 in connection with the base member 30. For example, the track 108 and rails 52 can be connected by one or more tongue and groove connections. As another example, flanges can extend from either element into elongated apertures or grooves in the other element to enable the desired sliding movement. In yet another example, one or more headed pins can extend from either element into elongated apertures or grooves in the other element. In another embodiment, the sliding member 46 can move though one or more apertures defined in one or more walls, lugs, tubes, or other elements mounted to integral with the base member 30. The apertures preferably function to guide the sliding member 46 in translational movement through the aperture and with respect to the base member 30. One having ordinary skill in the art will appreciate that still other manners of slidably connecting the sliding member 46 to the base member 30 are possible.

Depending upon the type of sliding connection employed, sliding motion of the sliding member 46 can be improved in a number of different manners. By way of example only, ball bearings between the base member 30 and the sliding member 46 can be employed, those portions of the base member 30 and sliding member in sliding contact with one another can be made from or coated with low-friction material such as Teflon® (Dupont Corporation) or UHMW plastic, one or more bearing elements such as low-friction glides, plates, and the like can be located between the base member 30 and the sliding member 46, etc.

The sliding member 46 is preferably elongated in shape. However, the sliding member 46 can instead be square, round, or take any other shape desired to which one or more fasteners (described below) can be mounted.

Preferably, a first end 48 of the sliding member 46 terminates in or at least partially defines a cam surface 54. Also preferably, the cam surface 54 is curved convexly toward the camming portion 34 on the handle 18. In this manner, when the sliding member 46 is located at a position (in its range of sliding positions) nearer to the second end 28 of the base member 30, the camming portion 34 of the handle 18 can exert force upon the cam surface 54 of the sliding member 46 and can thereby move the sliding member 46 toward the first end 26 of the base member 30.

A convexly-shaped cam surface 54 on the sliding member 46 is highly preferred for its ability to smoothly transfer force from the camming portion 34 to sliding force of the sliding member 46. However, other cam surface shapes can be employed as desired, including without limitation concavely-shaped cam surfaces, flat cam surfaces disposed at an angle with respect to the camming portion 34, and the like. In other embodiments, the cam surface 54 can be defined by any portion of the sliding member 46 that is cammed against by the camming portion 34 to move the sliding member 46. Such surfaces can be defined by the end of a post extending from the sliding member 46, a pin, rod, boss, or other protrusion connected to or integral with the cam surface 54, an end wall of the sliding member 46, or any other portion of the sliding member 46 that can be contacted by the camming portion 34 when the sliding member 46 is positioned as described above.

In the illustrated preferred embodiment of FIGS. 1–11, the cam surface 54 is located at an end of the sliding member 46. However, the cam surface 54 can instead be located anywhere on the sliding member 46 depending at least in part upon the shape of the sliding member 46 and the positional relationship of the sliding member 46 with respect to the camming portion 34. For example, the cam surface 54 can even be defined by an interior aperture wall in the sliding member 46 though which the camming portion 34 can move to push the wall (and therefore the sliding member 46) as described above.

Although some types of camming elements and relationships are described above and illustrated in the figures, it should be noted that any element connected to or integral with the handle 18 that is capable of directly or indirectly exerting a camming force upon a surface of the sliding member 46 can be employed.

Preferably, movement of the sliding member 46 causes one or more fasteners on the sliding member 46 and/or on the base member 30 to engage, thereby securing the door handle assembly 14 to the door 12. In the illustrated preferred embodiment, sliding member 46 has two clips 64, 66 connected thereto (although any other number of clips can instead be used). The clips 64, 66 are preferably connected to the sliding member 46 by being insert-molded or heat-staked to the sliding member 46. In other embodiments, the clips 64, 66 can be connected to the sliding member 46 by threaded fasteners, rivets, pins, and other conventional fasteners, by welds, brazing, snap-fitting, crimping, adhesive, or in any other manner desired.

The clips 64, 66 are preferably located in spaced relationship on the sliding member 46, and each preferably have a recess 72, 74 within which another fastener can be received. Specifically, the clip recesses 72, 74 are preferably sized and shaped to receive respective studs 60, 62 extending from the base member 30 as shown and/or from the door 12 (not shown). Depending upon the location of studs 60, 62 on the base member 30, the sliding member 46 can be provided with one or more apertures or recesses to enable the sliding member 46 to move without interference with the studs. For example, the sliding member 46 in the embodiment illustrated in FIGS. 1–11 has an elongated aperture 56 in which one of the studs 60 is received. The elongated aperture 56 is sufficiently long to enable the sliding member 46 to move without interference with the stud 60. The number, location, and shape of such apertures in the sliding member 46 are preferably selected according to the number, location, and shape of fasteners (such as studs) which would otherwise interfere with movement of the sliding member 46.

The studs 60, 62 preferably have reduced neck portions or have enlarged heads which permit the clips 64, 66 to engage with the studs 60, 62. Most preferably, the clips 64, 66 are retained beneath the heads of the studs 60, 62 as shown in FIGS. 6, 7, 9, and 11. The clips 64, 66 can be made of resiliently deformable material such as spring steel or plastic in order to resiliently maintain an engaged position with respect to the studs 60, 62 when engaged therewith. Although the clips 64, 66 can have any shape capable of retaining the studs 60, 62 in clip recesses, the clips 64, 66 are more preferably curved for a more positive engagement with the studs 60, 62.

In some preferred embodiments, the clips 64, 66 engage with the studs 60, 62 about a portion of the door 12, thereby trapping that portion of the door 12 and securing the door handle assembly 14 to the door 12. Most preferably, the portion of the door is an integral portion of the door, such as an area of the door that is stamped, molded, or otherwise formed from a wall of the door. Alternatively, the portion of the door can be one or more elements attached thereto, such as one or more plates, walls, fingers, a frame, and the like connected to a wall of the door in any conventional manner. With reference to the illustrated preferred embodiment in FIGS. 1 and 8–11 for example, the door 12 preferably has one or more frame elements located behind the door aperture 16 (located within the door 12). As mentioned above, these frame elements can be integral with the door or can be attached thereto in any conventional manner. The frame elements can be or take the shape of one or more bars, plates, tubes, or other members at least partially defining a well 90 behind the door aperture 16 within which the door handle assembly 14 is received. The well 90 can be defined by the periphery of the door aperture 16 and a single bar or plate located behind the aperture 16, or can be more fully defined by one or more plates spanning the aperture 16 as shown in the figures. Accordingly, the well 90 need not be an enclosure, and in some embodiments only serves the purpose of providing framework behind the aperture 16 to which the door handle assembly 14 can be attached. Although elements located behind the door aperture 16 and at least partially defining the well 90 can be integral with or connected to internal door framework or other elements of the door 12, such elements are more preferably integral with or connected to an internal surface of the door 12 adjacent to the door aperture 16.

Whether formed from part of the door or attached to the door as described above, the elements behind the door aperture 16 defining the well 90 can take any shape desired and can enclose any portion of interior of the door aperture 16. However, these elements preferably do not interfere with full insertion of the door handle assembly 14 in the door aperture 16.

The well 90 in the illustrated preferred embodiment of FIGS. 1 and 8–11 is preferably defined by the periphery of the door aperture 16 and by a plate 86 spanning the door aperture 16 from within the door 12. The plate 86 is most preferably integral with the door 12, but can instead be attached in any conventional manner (e.g., by screws, bolts, rivets, clips, pins, and other conventional fasteners, by welding as illustrated, by brazing or adhesive, and the like) to the interior periphery of the door aperture 16. In those embodiments in which the plate 86 is attached to the door 12, the plate 86 can have flange portions 92, 94 connecting the plate 86 to the door 12 (see FIGS. 8 and 9).

The plate 86 is preferably shaped to receive at least part of the door handle assembly 14. To this end, the plate can be stamped, bent, pressed, cast, molded, defined by multiple plates connected together, or shaped in any other conventional manner.

Preferably, the fasteners 60, 62, 64, 66 engage with the plate 86 (or other framework defining the well 90) to secure the door handle assembly 14 to the door 12. To this end, the plate 86 preferably has at least one aperture therein through which the fastener(s) on the door handle assembly 14 can be attached. In the illustrated preferred embodiment shown in FIGS. 1–11, four apertures 96, 98, 100, 102 exist in the plate 86. Two of the apertures 96, 98 are shaped and sized to receive the studs 60, 62, while two of the apertures 100, 102 are shaped and sized to receive the clips 64, 66. Because the clips 64, 66 are movable with the sliding member 46 in the illustrated preferred embodiment, the apertures 100, 102 are preferably sufficiently large (e.g., widened, elongated, and the like) to permit this movement. Apart from being shaped to receive the fasteners 60, 62, 64, 66 and to permit relative movement of the fasteners 60, 62, 64, 66 as described above, the apertures 96, 98, 100, 102 can be any shape and size desired and can be located fully or partially in the plate 86. Two or more of the apertures 96, 98, 100, 102 can even be connected or otherwise defined by a single aperture, if desired. The location of the apertures 96, 98, 100, 102 is dependent upon the location of the fasteners 60, 62, 64, 66 on the door handle assembly 14. However, the apertures 96, 98, 100, 102 can be located anywhere in the plate 86 depending upon where the fasteners 60, 62, 64, 66 are located upon the door handle assembly 14.

Although not required to practice the present invention, some preferred embodiments employ one or more flanges, pins, posts, or other protrusions on the base member 30 or on the door 12 for guiding the door handle assembly 14 into proper position in the door aperture 16 and for helping to retain the door handle assembly 14 in this position. These elements can be received within grooves, apertures, recesses or other mating elements of the door or base member, respectively. For example, the base member 30 in the illustrated preferred embodiment preferably has flanges 112 that are received within the door aperture 16, and help to properly position the door handle assembly 14 by using the edge of the door aperture 16 as reference structure.

Installation of the door handle assembly 14 illustrated in FIGS. 1–11 is accomplished in the following manner. With the handle 18 retained in the open position (i.e., pulled away from the base member 30 and rotated about the hinge 32) and the sliding member 46 initially located at its position closest to the second end 28 of the base member 30, the door handle assembly 14 is inserted within the door aperture 16. Preferably, the flanges 112 align the door handle assembly 14 in the door aperture 16. The door handle assembly 14 can pass along an insertion path A that is substantially perpendicular to the plane of the door aperture 16, or can be inserted at an angle with respect thereto as needed for clearance of door handle assembly components past the edges of the door aperture 16. If necessary, the door handle assembly 14 can be rotated some amount during this insertion. As the door handle assembly 14 is inserted through the door aperture 16, the first and second studs 60, 62 preferably align with and are inserted into the first and second apertures 96, 98 in the plate 86. The first and second clips 64, 66 are preferably inserted into the third and fourth apertures 100, 102. When the door handle assembly 14 is installed manually, the installer can preferably fully insert the door handle assembly 14 into the door aperture 16 with one hand.

Preferably, the door handle assembly 14 is inserted into the door aperture 16 until the base 30 of the door handle assembly 14 comes into contact with the door 12. Applying a force to the handle 18 in a general direction toward the door 12 to close the door handle 18 then causes the camming portion 34 to cam against the cam surface 54 of the sliding member 46. This camming motion causes the sliding member 46 to slide with respect to the base member 30 and to connect the first and second clips 64, 66 to the first and second studs 60, 62, thereby securely connecting the door handle assembly 14 to the door 12.

In the illustrated preferred embodiment, the connection between the clips 64, 66 and the studs 60, 62 traps a portion of the plate 86 located between the apertures 96, 98, 100, 102, preventing removal of the door handle assembly 14 once installed. It will be appreciated that other types of fasteners and other fastener arrangements can be employed to result in a similar connection retaining the door handle assembly 14 in a similar manner. For example, the clips 64, 66 and the studs 60, 62 can be reversed in position (in which case the studs 60, 62 could be mounted upon the sliding member 46 for movement with respect to stationary clips 64, 66 on the base member 30). As another example, the clips 64, 66 and studs 60, 62 can be replaced by any conventional fasteners, such as one or more pins on the sliding member 46 or base 30 engaging within apertures in one or more elements mounted upon or otherwise extending from the base 30 or sliding member 46, respectively. Alternatively, the clips 64, 66 and studs 60, 62 can be replaced by inter-engaging clips, magnet sets, snap-fit elements, hooks, or other conventional fastening elements and devices. In other embodiments, the fasteners can even be defined by features of the plate 86, base 30, and/or sliding member 46. By way of example only, one or more clips on the sliding member 46 can slide over a rib on the edge of the plate aperture to be retained thereby. Alternatively, the locations of the clip and rib can be reversed, or the clip and rib connection can be made between a clip or rib on the sliding member 46 connectable to a rib or clip on the base 30 (in a manner similar to the connection illustrated in FIGS. 1–11). Other features of the plate 86, base 30, and sliding member 46 can be employed to establish a connection between the sliding member 46 and plate 86 or between the sliding member 46 and base 30 in order to secure the sliding member 46 in actuated position. Such features include lips, ridges, bumps, apertures, and the like, to which conventional fasteners are connectable. These features can even be located on both the sliding member 46 and the plate 86 or on both the sliding member 46 and the base 30. For example, a bump or rib on the sliding member 46 can engage with a recess or aperture in the plate 86 (or vice versa) to retain the sliding member 46 in position with respect to the plate 86. In all such cases, the features of the sliding member 46, base 30, and plate 86 function as fasteners and are therefore included in the definition of "fasteners". Still other fastening elements can be employed that can be connected to retain the door handle assembly 14 in the door aperture 16 when the sliding member 46 has been sufficiently moved by actuation of the handle 18.

The fasteners 60, 62, 64, 66 used in the illustrated preferred embodiment are all located on the door handle assembly 14. In other embodiments, some of these fasteners can be located on the door structure (i.e., the plate 86, the wall of the door 12, or other elements of the door 12). By way of example only, the studs 60, 62 in the illustrated preferred embodiment can be located on the plate 86 rather than on the base member 30. In this regard, the sliding member 46 can have any number of fasteners that can engage with any number of fasteners (or other structure) on the plate 86, door wall, or other door structure when the sliding member 46 is moved by the handle 18.

In other embodiments of the present invention, different structures and devices can be used to retain the sliding member 46 in its desired actuated position following actuation of the handle 18 as described above. For example, a ratchet or spring-loaded pin or bearing can be mounted on the sliding member 46 and can engage with a detent, groove, recess, or aperture in the plate 86 or base member 30 when the sliding member 46 reaches a desired position. The ratchet or spring-loaded pin or bearing thereby secures the sliding member 46 in its actuated position. As another example, any conventional over–center biasing element or mechanism can be attached to the sliding member 46 to bias the sliding member toward the first end 26 of the base 30 after being actuated "over-center" by the camming portion 34. Still other structures and devices exist for retaining the sliding member in its actuated position, each one of which falls within the spirit and scope of the present invention.

Also in other embodiments, different elements can be used to retain the sliding member 46 (and therefore the door handle assembly 14) in the door aperture 16 after actuation of the sliding member 46. For example, one or more bars, fingers, or other elements can extend over a rear surface of the plate 86 when the sliding member 46 has been actuated, thereby sandwiching the plate 86 between such elements and the sliding member 46. As another example, a lip on the sliding member 46 can extend over part of the rear surface of the plate 86 in a similar manner when the sliding member 46 has been actuated. One having ordinary skill in the art will appreciate that still other elements can be employed for retaining the sliding member 46 connected to the plate 86 or other internal door structure.

In some preferred embodiments of the present invention, the handle 18 is retained in an open position until the door handle assembly 14 is installed in the door 12, after which time the door handle assembly 14 is moved (e.g., pushed) to its closed position to secure the door handle assembly 14 to the door 12. In order to retain the handle 18 in its open position, the installer or machine performing the installation can hold the handle 18 in its open position while the door handle assembly 14 is inserted within the door aperture 16. However, the handle 18 is more preferably mechanically retained in its open position until the handle 18 has been actuated to its closed position. A number of devices and elements can be employed to perform this function.

In the illustrated preferred embodiment for example, a pin 82 coupled to the sliding member 46 preferably extends toward and engages with the bracket 42 to limit rotation of the bracket 42 and therefore to limit rotation of the handle 18 connected thereto. The pin 82 can be attached to any location on the sliding member 46 and in any manner, including without limitation by one or more conventional fasteners, by welding, brazing, adhesive, snap-fitting, by being attached to a mount which is itself attached to the sliding member 46 in any conventional manner. Most preferably however, the pin 82 is integral with the sliding member 46. The pin preferably extends to a position in which it releasably engages with a notch 84 in the bracket 42, thereby limiting bracket rotation. When the handle 18 is actuated by an installer toward its closed position, the camming portion 34 moves the sliding member 46 as described above, thereby pulling the pin 82 from the notch 84 in the bracket 42 and enabling the spring 40 to exert its biasing closing force upon the handle 18 as also described above.

One having ordinary skill in the art will appreciate that a number of other elements can be employed to enable the spring 40 only after initial actuation of the handle 18 toward its closed position. For example, other types of elements (e.g., differently shaped fingers, rods, and the like) can be mounted to the sliding member 46 for movement with respect to the bracket 42 when the sliding member 46 is moved. Alternatively, the camming portion 34 or part of the handle 18 can cause shifting, rotation, or other movement of the spring 40 from a position in which the spring 40 is not operatively connected to the bracket 34 to a position in which it is. As yet another example, one or more frangible elements can be positioned to shear, collapse, deform, snap, or otherwise break upon initial actuation of the handle 18 to its closed position. By way of example only, a shear pin can be located in the hinge 32 or in the camming portion aperture 44 to hold the handle 18 open and to shear upon initial closure of the handle 18. Alternatively, a membrane, collapsible wall, or other element can be connected to the body 30 for obstructing full entry of the camming portion 34 into the aperture 36 as described above. When the handle 18 is actuated to its closed position, the camming portion 34 preferably breaks, deforms, or otherwise passes this element under force exerted upon the handle 18. Still other frangible and non-frangible elements and devices for retaining the handle 18 in an open position until the handle 18 is first actuated to its closed position can be employed in the present handle assembly 18, each one of which falls within the spirit and scope of the present invention.

FIGS. 12–22 show a second preferred embodiment of the door handle assembly 214 according to the present invention. In this embodiment, the door handle assembly 214 is a lift or "paddle" type assembly having a handle 218 rotatably coupled to a base member 230 about an axis defined by one or more axles 232 (one axle 232 being employed in the illustrated preferred embodiment). The handle 218 is movable from a closed or unactuated position to an actuated or open position by lifting the handle 218. Preferably, the handle 218 is biased by a spring 240 directly or indirectly connected thereto. In the illustrated preferred embodiment, the spring 240 a torsion spring located on the axle 232, and has legs which are stopped by the base 230 and the bracket 242 of the handle 218. In other embodiments, such a spring can be positioned in a conventional manner to bias other parts of the handle 218, the axle 232 itself, or any other element connected to the handle 218. The spring 240 need not necessarily be a torsion spring as shown. Other types of springs that can be used include extension, compression, and leaf springs. One having ordinary skill in the art will appreciate that each type of spring that can be used to bias the handle 218 to its closed position can be mounted in a number of different manners, such as to the base 230, to the axle 232 (e.g., FIGS. 12–22), to either or both handle brackets 242, and the like. Also, other types of biasing elements can instead be employed as desired, including without limitation elastic bands, magnet sets, and the like.

A linking element (not shown) is preferably directly or indirectly coupled to the handle 218 and to a latch (also not shown) for releasing the latch when in its unlocked state as is well known in the art. In the illustrated preferred embodiment of FIGS. 12–22 for example, the linking element can be connected to a bracket 242 which is itself rotatably connected to the handle 218 for rotation about the axle 232. An aperture 244 is preferably provided in the bracket 242 for this connection. Therefore, actuation of the handle 218 generates rotation of the bracket 242 and transmits motive force to the linking element for unlatching the connected latch.

The door handle assembly 214 illustrated in FIGS. 12–22 is presented to provide an example of how the principles of the present invention can be applied to different types of door handle assemblies. Specifically, the door handle assembly 214 of this second embodiment shares the same inventive principles of the first embodiment, but illustrates how the actuation force from the handle 218 can be transmitted to the sliding member 246 in a different manner. A primary inventive feature of the present invention is based not upon the mechanism, element, or manner used to transmit force from the handle 218 to the sliding member 246, but instead upon actuation and movement of the sliding member 246 responsive to handle actuation (and preferably responsive to handle closure) in order to secure the door handle assembly 214 to the door 212. One having ordinary skill in the art will appreciate that numerous different elements and devices can be used to transmit force from the handle 18, 218 to move the sliding member 46, 246. The first preferred embodiment described above and illustrated in FIGS. 1–11 performs this task by a camming action between a part of the handle 18 (the camming portion 34) and the sliding member 46. As will now be described, the second preferred embodiment performs this task by pulling or drawing the sliding member 246 using rotational force from the handle 218.

The handle 218 of the door handle assembly 214 can be mounted in a number of different manners for rotation about an axis defined by the axle 232. Preferably, the axle 232 is mounted to the base member 230 by one or more bosses 314 which can be integral with the base member 230 or can be connected thereto in any conventional manner. Most preferably, at least two bosses 314 support the ends of the axle 232 about which the handle 218 can pivot. The door handle 218 can have one or more arms 315 extending to and attached for rotation with axle 232, or can be rotatably connected to the axle 232 in any other manner (depending at least partially upon the shape of the handle 218). As shown by way of example in FIGS. 12–22, the handle 218 can extend through one or more apertures 316 in the base member 230 to connect to the axle 232, if necessary.

The door handle assembly 214 preferably has at least one bracket 242 as described above. More preferably, the door handle assembly 214 has at least two brackets 242. The brackets 242 are preferably connected to the handle 218 in any conventional manner, such as by one or more bolts, screws, rivets, pins, clamps, or other conventional fasteners, by welding, brazing, adhesive, snap-fitting, and the like. The brackets 242 can instead be connected in a conventional manner directly to the axle 232 or to part of the handle 218 for rotation therewith responsive to rotation of the handle 218. In other embodiments, the brackets 242 are integral with the handle 218 and/or with the axle 232.

The door handle assembly 214 preferably employs a sliding member 246 and one or more fasteners 260, 264 to secure the door handle assembly 214 to the door 212. The sliding member 246 and fasteners 260, 264 preferably have the same or similar structure and preferably operate in the same or similar manner as the sliding member 46 and fasteners 60, 64 of the first preferred embodiment illustrated in FIGS. 1–11, and can be replaced by elements and structure performing the same or similar functions as also described above with respect to the first preferred embodiment. The second preferred embodiment has two fasteners (e.g., an inter-engaging clip 264 and stud 260 similar to the clip 64 and stud 60 in the first preferred embodiment), at least one of which is movable with respect to the other by sliding the sliding member 246 connected to one of the fasteners. Although the fasteners in the second preferred embodiment can be reversed, the clip 264 is preferably connected to the sliding member 246, which is movable with respect to the stud 260 connected to the base member 230.

As described in greater detail above with respect to the first preferred embodiment, the sliding member 246 can be moved to engage the clip 264 with the stud 260, thereby securing the sliding member 246 and the door handle assembly 214 to the door 212. In this regard, the fasteners 260, 264 can be received within one or more apertures in a plate 286 of the door 212 (for being connected thereto in the same or similar manner as the fasteners 60, 62, 64, 66 are connected the plate 86 in the first preferred embodiment). Alternatively, the fasteners 260, 264 can secure the door handle assembly 214 to the door 212 in any of the other manners also described above.

Like the studs 60, 62 of the first preferred embodiment, the stud 260 of the second preferred embodiment is preferably connected to or integral with the base member 230 or the door 212 (e.g., plate 286 of the door 212).

The door handle assembly 214 is preferably connected to a door 212 by sliding the sliding member 246 having one fastener 264 thereon to a fastened position in which the fastener 264 retains or helps to retain the door handle assembly 214 to the door 212. In some preferred embodiments such as that illustrated in the figures, the door handle assembly 214 is connected to a door 212 by sliding a sliding member 246 having one fastener 264 toward another fastener 260 and by then connecting the fasteners 260, 264 together. To exert motive force upon the sliding member 246 in the second preferred embodiment, the handle 218 is connected to the sliding member 246 by at least one link 318. Preferably, the handle 218 is connected to the sliding member 246 by two or more links 318 as shown in FIGS. 15–22.

The links 318 can have any shape and size capable of connecting the handle 218 to the sliding member 246. Preferably however, the links 318 are elongated elements connected at one end to the brackets 242 and directly or indirectly connected at another end to the sliding member 246. These connections can be made in any manner desired, but are preferably rotatable connections. By way of example only, the brackets 242 in the illustrated preferred embodiment are rotatably connected to the links 318 by threaded extensions of the links 318 received and secured within apertures in the brackets 242 by nuts. Alternatively, the links 318 can be connected to the brackets 242 in any other conventional manner, including without limitation by one or more bolts, rivets, pins, or other conventional fasteners, axles, hinges, joints, and the like. Also by way of example only, the sliding member 246 in the illustrated preferred embodiment is rotatably connected to the links 318 by an axle 320 connected to the sliding member 246 and received within apertures 322 in the links 318. In other embodiments, the links 318 can be connected to the sliding member 246 in any other conventional manner, including those described above with reference to the connections between the links 318 and the brackets 242.

The axle 320 can be located anywhere on the sliding member 246, such as at a distal end of the sliding member 246 as shown in the figures. The axle 320 can be integrally formed with the sliding member 246, can comprise a pin member extending through a channel spanning the width of the sliding member 246, can comprise two axle members extending from opposite sides of the sliding member 246, and the like.

By employing the links 318 connected between the door handle 218 and the sliding member 246, the rotational force of the door handle 218 can be transmitted to the sliding member 246 in order to translate the sliding member 246. One having ordinary skill in the art will appreciate that other elements and connections serving as force transfer mechanisms between the door handle 218 and the sliding member 246 can transmit this force to perform the same function. For example, the links 318 can be connected directly to the door handle 218, if desired (in which case the brackets 242 can be eliminated). As another example, the handle 218 or brackets 242 can push, cam, press, or otherwise exert motive force against a lever, pivot, plate, or other element rotatably mounted with respect to the sliding member 246. This lever, pivot, plate, or other element can thereby respond by directly or indirectly exerting motive force upon the sliding member 246 to move the sliding member 246. In another embodiment, the handle 218 (or an extension or element thereof) can be shaped to directly move the sliding member 246. For example, the handle 218 can have a finger, arm, or other extension extending to a position in which initial actuation of the handle 218 to its closed position pushes the sliding member 246 as described above. Still other elements and connections capable of moving the sliding member 246 responsive to handle actuation are possible and fall within the spirit and scope of the present invention. In this regard, it should be noted that the sliding member 246 need not necessarily be pushed or pulled in any particular direction with respect to the other components of the latch assembly 214 (with the exception of the fastener to which the sliding member connects). For example, the sliding member 246 in the second preferred embodiment illustrated in FIGS. 12–22 can be positioned to move in a downward direction during initial actuation of the handle 218. One having ordinary skill in the art will appreciate that this can be accomplished in a number of different manners. In one embodiment, the arms 315 of the handle 218 can be shaped to have a surface that passes the top end of the sliding member 246 as viewed in FIGS. 15–18 and that is shaped to cam against this portion of the sliding member 246 when the handle 218 is initially actuated. Such motion thereby pushes the sliding member 246 into position as described above. In other embodiments, the sliding member 246 can be actuated in any other direction desired, (such as a lateral direction).

In order to permit unrestricted (or substantially unrestricted) movement of the handle 218 after the sliding member 246 has been moved by the handle 218, a lost-motion connection preferably exists between the handle 218 and the sliding member 246. This lost-motion connection can be located, for example, at the connection between the brackets 242 and the axle 232 or handle 218, the connection between the brackets 242 and the links 318, or the connection between the links 318 and the sliding member 246. In the illustrated preferred embodiment, the lost-motion connection is between the links 318 and the axle 320 connected to the sliding member 246, and is defined by the elongated shape of the apertures 322 in the links 318. The elongated apertures 322 permit movement of the axle 320 along the apertures 322 without transmitting motive force to the sliding member 246 after connection of the fasteners 260, 264. Different forms of lost-motion connection are possible, and depend at least partially upon the shape of the elements sharing the lost-motion connection and the manner in which these elements are connected. Lost-motion connections and their various forms are well known to those skilled in the art and art not therefore described further herein.

In some preferred embodiments of the present invention such as that shown in FIGS. 12–22, the handle 218 of the door handle assembly 214 is maintained in an open position prior to and during insertion of the door handle 218 into a door aperture 216. As described in greater detail with regard to the first preferred embodiment illustrated in FIGS. 1–11, this enables a user or machine to insert and secure the door handle assembly 214 within the door aperture 216 by exerting force(s) toward the door 212. A number of different devices and elements can be used to retain the handle 218 in an open position until actuated by a user to secure the assembly 214 in the door aperture 216. In one embodiment shown in FIGS. 12–22, a retaining arm 350 is mounted upon the axle 232 of the handle 218, and preferably has a hook portion 352 which is at least initially connected to the axle 320. By its connection to the axle 232 of the handle 218, the retaining arm 350 prevents rotation of the axle 232 when the retaining arm 350 is hooked to the axle 320 of the sliding member 246. In those embodiments having a spring 240 to bias the handle 218 to its closed position, the sliding member 246 preferably has sufficient frictional resistance to sliding in order to resist rotation of the handle axle 232, brackets 242, and retaining arm 350. Therefore, the retaining arm 350 blocks rotation of the axle 232 (and handle 218 connected thereto) by connecting the axle 232 to the sliding member 246.

Preferably, when the handle 218 illustrated in FIGS. 12–22 is actuated to its closed position, the retaining arm 350 rotates with the axle 232 of the handle 218 to a position in which the retaining arm 350 is no longer hooked to the axle 320 of the sliding member 246. Because this same movement of the handle 218 also causes the sliding member 246 and the axle 320 connected thereto to move with respect to the base 230, subsequent actuation of the handle 218 to its open position does not generate interference of the retaining arm 350 with the axle 320. In this regard, the retaining arm 350 is preferably shaped to avoid such interference, such as by having a recessed portion 354 as shown in the figures.

Other retaining arm shapes 350 capable of performing these same functions (i.e., directly or indirectly connecting to the sliding member 246 in a releasable manner to prevent rotation of the handle prior to disconnection from the sliding member) are possible, each one of which falls within the spirit and scope of the present invention. By way of example only, the axle 320 of the sliding member 246 can be received within an oversized aperture in the retaining arm 350 to provide a lost-motion connection between these elements after the axle 320 and the sliding member 246 have been moved.

It should also be noted that other types of elements and mechanisms can be employed to retain the handle 218 in its actuated state until actuation of the handle 218 to a closed position. For example, an arm can be mounted to the handle axle 232, to either or both brackets 242, or even to the arms 315 of the handle 218 and can extend behind the sliding member axle 320. By being trapped behind the sliding member axle 320, this arm prevents rotation of the brackets 242 until the sliding member 246 is moved as described above (by actuation of the handle 218 to its closed position), after which time the arm moves without obstruction. As another example, a frangible element can be used which shears, collapses, deforms, snaps, or otherwise breaks upon actuation of the handle 218 to a closed position. Such an element can be a bar, band, string or other breakable element extending from the handle bracket(s) 242, sliding member 246, sliding member axle 320, or links 318, to the base 320, boss(es) 314, or other stationary element of the handle assembly 214. Alternatively, this element can be a pin, bar, or other element positioned between the handle 218 and the base 230 and which readily breaks under pressure by the handle 218 to its closed position. Other frangible elements (e.g. shear pins, etc.) can instead be used as desired. One having ordinary skill in the art will appreciate that still other devices and elements can be used to retain the handle 218 in its open position until first actuation to its closed position, each one of which falls within the spirit and scope of the present invention.

A preferred manner of installing a lift-type door handle assembly such as that shown in FIGS. 12–22 is as follows. The door handle assembly 214 is preferably aligned with an aperture 216 in the door 212 and is inserted through the aperture 216 along an insertion path. Like the first preferred embodiment, the door handle 214 may be rotated in one or more directions during insertion into the aperture 216 and may be inserted along a straight or curved path. Preferably, after apertures in the plate 286 have received the fasteners 260, 264, the door handle assembly 214 is completely inserted within the aperture 216.

Also preferably, the handle 218 is held in the open position while the door handle assembly 214 is inserted into the door aperture 216. After the door handle assembly 214 has been inserted within the door aperture 216, force applied to the handle 218 is transferred to the sliding member 246 in order to move the fastener 264 thereon for connection of the door handle assembly 214 to the door 212. The force applied to the handle 218 is preferably force exerted in a direction toward the door (for ease of installation), and preferably causes the fastener 264 on the sliding member 246 to connect with a second fastener 260 as described above.

With reference to the illustrated preferred embodiment in FIGS. 12–22, depression of the handle 218 rotates the handle 218 about the axle 232. Initially, the sliding member axle 320 is positioned at the distal end of the apertures 322 in the links 318. The links 318 transfer the rotational force from the handle 218 to the sliding member 246 by pulling on the sliding member axle 320. As the handle 218 and links 318 are actuated further, the sliding member 246 shuttles along the base 230. The clip 264 on the sliding member 246 preferably slidably engages the stud 260 and couples the door handle assembly 214 to the motor vehicle door 212. Subsequent actuation of the handle 218 may cause the links 318 to move. However, the preferred lost-motion connection of the links 318 causes the sliding member 246 to remain stationary, coupling the door handle assembly 214 and the motor vehicle door 212. In particular, the sliding member axle 320 preferably travels freely in the elongated link apertures 322 without being pulled by the links 318.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, the sliding member 46, 246 in the illustrated preferred embodiments is moved by force exerted directly or indirectly from actuation of the handle 18, 218. The forces in these embodiments are a camming force and a pulling force upon the sliding members 46, 246, respectively. One having ordinary skill in the art will appreciate that the particular manner in which force is exerted upon the sliding member 46, 246 can be different in other embodiments of the present invention. Depending at least partially upon the relative positions of the sliding member 46, 246 and the elements exerting force thereto from the handle 18, 218, the force received by the sliding member 46, 246 can be pulling, pushing, camming, or any other type of force.

By way of example only, force can be transferred in the first preferred embodiment from the handle 18 to the sliding member 46 in non-camming manners. The handle 18 (e.g., an end of the handle 18 such as the portion 34) could be connected to the sliding member 46 by a bar, rod, arm, or other element defining a linkage between the sliding member 46 and the handle 18. When the handle 18 is actuated to a closed position, the handle 18 pushes upon the linkage, which in turn pushes upon and moves the sliding member 46. Such a transfer of force need not include a camming motion, and so the portion 34 of the handle 18 would not be a "camming" portion. The connection between the linkage and the sliding member 46 and the connection between the linkage and the handle 18 could be made in any conventional manner, such as pivotal connections via pins, posts, or other joints. At least one of these connections would preferably be a lost-motion connection to enable the handle 18 to move without pulling the sliding member 46 back toward its original position after initial closure of the handle 18. Other types of connections between the handle 18 and the sliding member 46 can also be made to transfer force from the handle 18 to the sliding member 46, each one of which falls within the spirit and scope of the present invention.

As another example, if the sliding member axle 320 in the second preferred embodiment were located on the opposite end of the sliding member 246 (with longer links 318 still connected thereto), the motive force applied to the sliding member 246 by handle actuation would more appropriately be identified as a pushing force rather than a pulling force.

Other types of fasteners can be employed engage to secure the door handle assembly 14, 214 to the door 12, 212, but that do so without or in addition to translational movement. In other words, a movable fastener in the present invention need not necessarily be connected to a sliding member in order to perform its connecting function. Other types of fastener movement (in response to handle actuation) are possible, including without limitation rotational, swinging, rocking, lifting, or tilting movement of the member upon which the fastener is attached, such member being rotated, swung, rocked, lifted, or tilted by force exerted directly or indirectly from actuation of the handle. Most preferably, each of these types of movement are generated when the handle is moved to a closed position, force from the closing handle is transmitted to a member upon which the fastener is located, and the member responds by moving as noted to move the fastener. If desired, the fastener is thereby moved into contact with another fastener to secure the handle assembly to the door. Alternative types of fastener movement to secure the door handle assembly of the present invention to a door are considered to be within the spirit and scope of the present invention.

In each of the preferred embodiments described above and illustrated in the figures, actuation of the handle 18, 218 to its closed position generates the desired motion for securing the door handle assembly 14, 214 to the door 12, 212. This arrangement is preferred due to the ability of an installer or an installation apparatus to easily insert and actuate the door handle assembly by exerting force in the same general direction (e.g., toward the door). However, it should be noted that in other embodiments of the present invention, actuation of the handle 18, 218 to its open position instead generates the desired motion for securing the door handle assembly 14, 214 to the door 12, 212. These alternative embodiments can operate in a similar manner to those described above and illustrated in the figures. For example, the camming portion 34 camming portion aperture 36, and the cam surface 54 in the first preferred embodiment can be located on an opposite end of the handle 18 in order to cam the sliding member 46 in an opposite direction upon opening of the handle 18. In such a case, the fasteners 60, 62, 64, and 66 would preferably be reversed in orientation to result in the connection between the door handle assembly 14, 214 and the door 12, 212. As another example, the sliding member 246 and fastener 264 thereon can be reversed in the embodiment shown in FIGS. 12–22 and the positions of the links 318 and/or the elongated apertures 322 therein can be changed so that the sliding member axle 320 is located at the opposite ends of the elongated apertures 322 (opposite to that shown in FIGS. 15–18) when the handle 218 is in its closed position. Opening of the handle 218 would therefore generate the desired movement of the sliding member 246. In still other embodiments, the sliding member 46, 246 can be mounted to move in different manners responsive to motive force exerted by the handle. For example, the sliding member 46, 246 can be mounted to pivot or to pivot and translate to establish the desired connection between the fasteners 60, 62, 64, 66.

We claim:

1. A door handle assembly for mounting to a motor vehicle door having an aperture defined therein for receiving the door handle assembly installed in the aperture in a first direction, the door handle assembly comprising:

a handle rotatably coupled to a base member and movable through a range of positions including an open position and a closed position;

a first fastener slidably mounted to the base member;

a force transfer mechanism operatively coupling the handle to the first fastener, the first fastener movable responsive to force applied to the handle in substantially the same direction as the first direction; and a second fastener coupled to the base member and connectable to the first fastener via movement of the first fastener to connect the door handle assembly to the door.

2. The door handle assembly of claim 1, further comprising a sliding member to which the first fastener is coupled, wherein the force transfer mechanism comprises a camming portion extending from the handle and a cam surface located on the sliding member, the sliding member movable by camming force from the camming portion to the cam surface of the sliding member.

3. The door handle assembly of claim 1, wherein the second fastener is a stud extending from the base member.

4. The door handle assembly of claim 3, wherein the door handle assembly is adapted to be installed within a well at least partially defined by the aperture and an interior surface of the door within the well, the well having a first aperture defined therein sized to receive the first stud.

5. The door handle assembly of claim 3, further comprising a slide member slidably coupled to the base member and to which the first fastener is coupled, the slide member having a first end operatively coupled to the handle and a second end having a clip with an indentation sized to receive the stud.

6. The door handle assembly of claim 5, wherein the slide member has an aperture defined therein sized to receive the stud, the aperture sufficiently large to enable the slide member to slide along the base member substantially unrestricted by the stud.

7. A method of coupling a door handle assembly to a motor vehicle door, the method comprising:

providing a door handle assembly having a base member and a first fastener coupled to the base member;

substantially aligning the door handle assembly with an aperture in the motor vehicle door;

applying a first force to the door handle assembly in a direction toward the motor vehicle door to insert the door handle assembly into the aperture in the motor vehicle door;

holding a handle of the door handle assembly in a first position during insertion of the door handle assembly into the aperture;

applying a second force to the handle in a direction toward the motor vehicle door;

transmitting at least part of the second force to the first fastener;

moving the first fastener in response to transmitting at least part of the second force to the first fastener; and coupling the door handle assembly to the motor vehicle door with the first fastener by moving the first fastener.

8. The method of claim 7, further comprising inserting a first stud extending from the base member through a first aperture in the motor vehicle door.

9. The method of claim 8, further comprising coupling the first stud and the first fastener by moving the first fastener with respect to the first stud to couple the door handle assembly to the motor vehicle door.

10. The method of claim 8, wherein the first fastener comprises a clip with an indentation for connection to the first stud.

11. The method of claim 7, further comprising:

transmitting another part of the second force to a second fastener coupled to a biasing member of the door handle assembly;

moving the second fastener in response to transmitting another part of the second force to the second fastener; and disconnecting the second fastener to enable the biasing member to exert biasing force upon the handle.

12. The method of claim 7, wherein transmitting the second force includes camming a camming portion coupled to the handle against a cam surface of a sliding member coupled to the first fastener.

13. A door handle assembly adapted for installation in a motor vehicle door having an aperture for receiving the door handle assembly, the door handle assembly comprising:

a base member;

a handle movably coupled to a base member, the handle movable between an open position and a closed position, the handle having a camming portion extending through the base member; and a sliding member coupled to the base member, the sliding member having a cam surface against which the camming portion cams in movement of the handle to the closed position;

a first fastener coupled to the sliding member;

wherein the sliding member is movable by the camming portion of the handle against the cam surface of the sliding member to connect the door handle assembly to the motor vehicle door with the first fastener.

14. The door handle assembly of claim 13, further comprising a second fastener coupled to the sliding member and releasably coupled to the handle, the second fastener movable with the sliding member between a first position in which the handle is retained by the second fastener in a first position with respect to the base member and a second position in which the handle is biased toward a second position by a biasing element.

15. The door handle assembly of claim 14, wherein:

the second fastener retains the handle in the open position when the second fastener is in the first position; and the second fastener is movable by actuation of the handle to a position in which the second fastener does not retain the handle in the first position.

16. The door handle assembly of claim 15, further comprising a bracket to which the biasing element is coupled, wherein the second fastener is a pin having a first end connected to the sliding member and a second end releasably engagable with the bracket.

17. The door handle assembly of claim 13, wherein the first fastener is a clip, the door handle assembly further comprising a stud connectable to the clip responsive to movement of the clip toward the stud.

18. The door handle assembly of claim 17, adapted for installation in motor vehicle door having a well defined by the aperture and at least one surface within the door adjacent to the aperture, wherein the stud and clip are positioned on the door handle assembly to be received within respective apertures in the surface.

19. The door handle assembly of claim 18, wherein the sliding member is movable with respect to the base member to connect the clip and the stud.

20. A vehicular door handle assembly for connection to a door panel of a vehicle, the vehicle door handle assembly comprising:

a base;

a handle movably coupled to the base and movable through a range of positions with respect to the base;

a sliding member coupled to the base and slidable with respect to the base, the sliding member movable by actuation of the handle in at least a portion of the range of positions of the handle; and a first fastener coupled to the sliding member;

a second fastener engagable with the first fastener, the first fastener movable with the sliding member between a first position in which the sliding member is not secured with respect to the door panel of the vehicle and the first and second fasteners are disengaged from one another and a second position in which the sliding member is secured with respect to the door panel of the vehicle via the first fastener and the first and second fasteners are engaged with one another.

21. The vehicular door handle assembly of claim 20, wherein:

the handle is movable between an open position and a closed position; and the sliding member is movable by actuation of the handle to its closed position.

22. The vehicular door handle assembly of claim 20, further comprising a cam surface on the sliding member, the handle movable to cam against the cam surface of the sliding member and to move the sliding member.

23. The vehicular door handle assembly of claim 22, further comprising a camming portion on the handle, the handle movable to exert camming force from the camming portion to the cam surface of the sliding member.

24. The vehicular door handle assembly of claim 20, further comprising a link coupled between the handle and the sliding member, the link transmitting rotational force from the door handle to the sliding member to move the sliding member.

25. The vehicular door handle assembly of claim 24, wherein the link is connected to at least one of the door handle and the sliding member by a lost-motion connection.

26. The vehicular door handle assembly of claim 25, wherein the link has an elongated aperture therein to which the sliding member is coupled to at least partially define the lost-motion connection.

27. The vehicular door handle assembly of claim 20, wherein the first fastener is connectable with the second fastener to secure the slide with respect to the door panel.

28. The vehicular door handle assembly of claim 20, wherein the second fastener is coupled to one of the base and the door.

29. The vehicular door handle assembly of claim 20, wherein the first fastener is one of a clip and a stud, and the second fastener is another one of a clip and a stud.

30. The vehicular door handle assembly of claim 20, wherein the first fastener is a stud extending from the base, the vehicular door handle assembly further comprising an aperture defined in the sliding member through which the stud extends, the aperture shaped to permit sliding movement of the slide substantially unrestricted by the stud.

31. The vehicular door handle assembly of claim 20, wherein the sliding member is slidable between a first position in which the first fastener on the sliding member is disconnected from the second fastener and a second position in which the first fastener on the sliding member is connected to the second fastener to couple the vehicular door handle assembly to the door panel.

32. The vehicular door handle assembly of claim 20 for installation in a door panel well within the aperture, the door panel well having at least one connection aperture defined therein, wherein the first fastener is positioned on the base to be received within the at least one connection aperture in the door panel well.

33. The vehicular door handle assembly of claim 32, wherein the at least one connection aperture is defined in a plate located within the door adjacent to the aperture of the door.

34. The vehicular door handle assembly of claim 20, further comprising:

a biasing element coupled to the handle to bias the handle to a closed position;

a third fastener movable between a first position in which the third fastener is coupled to the biasing element and a second position in which the third fastener is de-coupled from the biasing element, the biasing element capable of exerting motive force upon the handle when de-coupled from the third fastener and incapable of exerting motive force upon the handle when coupled to the third fastener.

35. The vehicular door handle assembly of claim 34, wherein the biasing element is a spring.

36. The vehicular door handle assembly of claim 35, further comprising a bracket upon which the spring is mounted, the bracket releasably engagable with the third fastener to enable and disable the spring.

37. The vehicular door handle assembly of claim 34, wherein the third fastener is movable by rotation of the handle in at least a portion of the range of positions of the handle.

38. The vehicular door handle assembly of claim 37, wherein the third fastener is coupled to the sliding member for movement therewith.

39. The vehicular door handle assembly of claim 31 wherein the second fastener comprises a pin coupled to the sliding member for movement therewith responsive to actuation of the handle.

40. A vehicle door handle assembly adapted to be mounted to a panel of a vehicle, the vehicle door handle assembly comprising:

a handle base;

a user-actuatable handle having an open position and a closed position with respect to the handle base;

a first fastener coupled to the handle base; and a second fastener engagable with the first fastener, the first fastener movable by actuation of the handle to the closed position to engage the first fastener to the second fastener and to connect the handle base to the panel of the vehicle.

41. The vehicle door handle assembly of claim 40, further comprising a sliding member coupled to the handle base and movable by actuation of the handle, the first fastener coupled to the sliding member for movement therewith.

42. The vehicle door handle assembly of claim 40, wherein the first fastener is movable by camming action of the handle moved toward the closed position.

43. The vehicle door handle assembly of claim 41, further comprising a cam surface on the sliding member, the handle movable to cam against the cam surface of the sliding member and to move the sliding member.

44. The vehicle door handle assembly of claim 43, further comprising a camming portion on the handle, the handle movable to exert camming force from the camming portion to the cam surface of the sliding member.

45. The vehicle door handle assembly of claim 40, further comprising at least one link coupled between the handle and the first fastener to transmit actuation force of the handle to the first fastener.

46. The vehicle door handle assembly of claim 41, further comprising at least one link coupled between the handle and the sliding member, the at least one link transmitting rotational force from the handle to the sliding member to move the sliding member.

47. The vehicle door handle assembly of claim 45, wherein the at least one link is connected to at least one of the door handle and the first fastener by a lost-motion connection.

48. The vehicle door handle assembly of claim 47, wherein the lost-motion connection is at least partially defined by an elongated aperture in the at least one link to which the sliding member is connected.

49. The vehicle door handle assembly of claim 40, wherein the second fastener is coupled to one of the handle base and the panel of the vehicle.

50. The vehicle door handle assembly of claim 40, wherein the first fastener is one of a clip and a stud, and the second fastener is another one of a clip and a stud.

51. The vehicle door handle assembly of claim 41, wherein the sliding member is slidable between a first position in which the first fastener on the sliding member is disconnected from the second fastener and a second position in which the first fastener on the sliding member is connected to the second fastener to couple the vehicle door handle assembly to the panel of the vehicle.

52. The vehicle door handle assembly of claim 40 for installation in a well in the vehicle panel, the well having at least one connection aperture defined therein, wherein the first fastener is positioned on the handle base to be received within the at least one connection aperture in the well.

53. The vehicle door handle assembly of claim 52, wherein the at least one connection aperture is defined in a plate at least partially defining a wall of the well.

54. The vehicle door handle assembly of claim 40, further comprising:

a biasing element coupled to the handle to bias the handle to a closed position;

a third fastener movable between a first position in which the third fastener is coupled to the biasing element and a second position in which the third fastener is de-coupled from the biasing element, the biasing element capable of exerting motive force upon the handle when de-coupled from the third fastener and incapable of exerting motive force upon the handle when coupled to the third fastener.

55. The vehicle door handle assembly of claim 54, wherein the biasing element is a spring.

56. The vehicle door handle assembly of claim 55, further comprising a bracket upon which the spring is mounted, the bracket releasably engagable with the third fastener to enable and disable the spring.

57. The vehicle door handle assembly of claims 56, wherein the third fastener is movable by rotation of the handle to the closed position.

58. A method of installing a vehicle door handle assembly within an aperture in a vehicle panel, the method comprising:

inserting the vehicle door handle assembly into the aperture in the vehicle panel with a handle of the vehicle door handle assembly in an actuated state;

moving the handle to an unactuated state without re-actuation of the handle;

moving a first fastener by movement of the handle to the unactuated state; and coupling a base of the vehicle door handle assembly to the vehicle panel by movement of the first fastener.

59. The method of claim 58, further comprising:

providing a well in the vehicle panel defined at least partially by the aperture and a surface behind the vehicle panel, the surface behind the vehicle panel having a connection aperture; and inserting the first fastener through the connection aperture in the well prior to moving the first fastener to couple the base of the vehicle door handle assembly to the vehicle panel.

60. The method of claim 58, further comprising sliding a sliding member on the base in response to moving the handle.

61. The method of claim 60, further comprising camming the handle against the sliding member to slide the sliding member on the base.

62. The method of claim 60, further comprising transmitting force from the handle to the sliding member by at least one link coupled between the handle and sliding member.

63. The method of claim 62, wherein the at least one link is rotatably coupled between the handle and the sliding member.

64. The method of claim 58, wherein coupling the base of the vehicle door handle assembly to the vehicle panel includes coupling the first fastener to a second fastener on one of the vehicle door handle assembly and the vehicle panel.

65. The method of claim 60, wherein the first fastener is coupled to the sliding member for movement therewith, the method further comprising connecting the first fastener with a second fastener on one of the vehicle door handle assembly and the vehicle panel by sliding the sliding member on the base.

66. The method of claim 58, further comprising enabling a biasing element coupled to the handle during movement of the handle to the unactuated state, whereby the biasing element exerts a biasing force upon the handle toward the unactuated state.

67. A method of installing a vehicle door handle assembly within an aperture in a vehicle panel, the method comprising:

inserting the vehicle door handle assembly into the aperture in the vehicle panel;

rotating a handle of the vehicle door handle assembly from an actuated position to an unactuated position to generate a rotational force;

transmitting the rotational force of the handle to translational force upon a first fastener of the vehicle door handle assembly;

translating the first fastener; and connecting the first fastener with a second fastener on one of the vehicle door handle assembly and the vehicle panel, the first and second fasteners connected to retain the vehicle door handle assembly within the aperture in the vehicle panel.

68. The method of claim 67, further comprising:

providing a well in the vehicle panel defined at least partially by the aperture and a surface behind the vehicle panel, the surface behind the vehicle panel having a connection aperture; and inserting the first fastener through the connection aperture in the well prior to translating the first fastener and connecting the first fastener with the second fastener.

69. The method of claim 67, further comprising sliding a sliding member on the vehicle door handle assembly in response to rotating the handle.

70. The method of claim 69, further comprising camming the handle against the sliding member to slide the sliding member.

71. The method of claim 69, further comprising transmitting force from the handle to the sliding member by at least one link coupled between the handle and sliding member.

72. The method of claim 71, wherein the at least one link is rotatably coupled between the handle and the sliding member.

73. The method of claim 69, wherein:

the first fastener is coupled to the sliding member for movement therewith; and the first fastener is coupled to the second fastener by sliding the sliding member.

74. The method of claim 67, further comprising enabling a biasing element coupled to the handle during movement of the handle to the unactuated position, whereby the biasing element exerts a biasing force upon the handle toward the unactuated position.

75. A motor vehicle door assembly comprising:

a motor vehicle door including an aperture to receive a door handle assembly; and a door handle assembly comprising:

a handle coupled to a base member, the handle movable through a range of positions, including an open position and a closed position; and a first fastener coupled to the base member and the handle, the first fastener movable by depression of the handle to a closed position toward the base member to couple the door handle assembly to the motor vehicle door.

76. The motor vehicle door assembly of claim 75, wherein:

the base member further comprises a first stud extending from the base member; and the motor vehicle door further comprises a plate having a first end connected to an interior surface of the motor vehicle door, the plate at least partially spanning the aperture and including a first connection aperture sized to receive the first stud.

77. The motor vehicle door assembly of claim 76, further comprising a sliding member slidably coupled to the base member, wherein the first fastener is coupled to the sliding member for movement therewith, the sliding member having a first end operatively connected to the handle for movement by the handle.

78. The motor vehicle door assembly of claim 75, wherein the handle has a camming portion movable by the handle to cam against a cam surface coupled to the first fastener, the first fastener movable by camming force upon the cam surface by the camming portion.

* * * * *